US011773871B2

(12) United States Patent
Lee et al.

(10) Patent No.: US 11,773,871 B2
(45) Date of Patent: Oct. 3, 2023

(54) BLOWER

(71) Applicant: LG ELECTRONICS INC., Seoul (KR)

(72) Inventors: Kunyoung Lee, Seoul (KR); Sumin Kim, Seoul (KR); Bohyun Kim, Seoul (KR); Myungjin Ku, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/901,173

(22) Filed: Sep. 1, 2022

(65) Prior Publication Data

US 2023/0071587 A1 Mar. 9, 2023

(30) Foreign Application Priority Data

Sep. 3, 2021 (KR) ..... 10-2021-0117649

(51) Int. Cl.

| | |
|---|---|
| ***F04D 29/52*** | (2006.01) |
| ***F04D 19/00*** | (2006.01) |
| ***F04D 25/06*** | (2006.01) |
| ***F04D 25/08*** | (2006.01) |
| ***F04D 29/70*** | (2006.01) |

(52) U.S. Cl.

CPC ..... *F04D 29/524* (2013.01); *F04D 19/002* (2013.01); *F04D 25/06* (2013.01); *F04D 25/08* (2013.01); *F04D 29/703* (2013.01)

(58) Field of Classification Search

CPC ..... F04D 29/524; F04D 19/002; F04D 25/06; F04D 25/08; F04D 29/703

See application file for complete search history.

(56) References Cited

U.S. PATENT DOCUMENTS

2014/0147297 A1 5/2014 Iyer et al.

FOREIGN PATENT DOCUMENTS

| | | | |
|---|---|---|---|
| CN | 206877265 | 1/2018 | |
| CN | 208846680 | 5/2019 | |
| CN | 209744554 | 12/2019 | |
| CN | 110848957 | 2/2020 | |
| JP | 2019-060294 | 4/2019 | |
| KR | 10-2010-0051724 | 5/2010 | |
| KR | 10-2020-0043737 | 4/2020 | |
| KR | 10-2020-0089362 | 7/2020 | |
| WO | WO-2021075896 A1 * | 4/2021 | ..... F24F 11/79 |
| WO | WO 2021/107696 | 6/2021 | |

OTHER PUBLICATIONS

Korean Notice of Allowance dated Jan. 7, 2023 issued in Application No. 10-2021-0117649.

European Search Report dated Jan. 25, 2023 issued in Application No. 22193612.3.

* cited by examiner

*Primary Examiner* — Jacob M Amick
*Assistant Examiner* — Charles J Brauch
(74) *Attorney, Agent, or Firm* — KED & ASSOCIATES, LLP

(57) ABSTRACT

A blower includes: a fan; a lower body having an inner space to receive the fan, and a suction hole; a first upper body communicating with the inner space and having a surface with a first discharge hole; a first damper movably coupled to the first upper body and penetrating the surface; the first damper having a first end facing an outside of the first upper body and a second end opposite to the first end; and a first bar extending along and coupled to the second end of the first damper.

19 Claims, 27 Drawing Sheets

BLOWER

CROSS-REFERENCE TO RELATED APPLICATION

This application claims the priority benefit of Korean Patent Application No. 10-2021-0117649, filed in Korea on Sep. 3, 2021, the disclosure of which is incorporated herein by reference in its entirety.

BACKGROUND

1. Field

The present disclosure relates to a blower. More particularly, the present disclosure relates to a blower capable of controlling a blowing direction.

2. Background

A blower may cause a flow of air to circulate air in an indoor space, or to form an airflow toward a user. In addition, a filter provided in the blower can purify indoor air.

In this regard, Korean Patent Publication Number KR2010-0051724 discloses an example of a blower that forms an airflow by using the Coandă effect in which an air flow tends to follow a curved surface. The nozzle of this blower may form an airflow toward the outside of the blower, while forming an internal passage through which air flowing by an impeller passes. However, this blower does not include a mechanism for controlling a direction of the airflow.

BRIEF DESCRIPTION OF THE DRAWINGS

Embodiments will be described in detail with reference to the following drawings in which like reference numerals refer to like elements, and wherein:

FIG. 7 is a top view of a blower, and FIG. 8 is a perspective view of a blower in which a dotted arrow expresses the diffusion airflow;

FIG. 9 is a top view of the blower, and FIG. 10 is a perspective view of the blower in which a dotted arrow expresses the upward airflow;

FIG. 24 is a view showing a bar according to an example of the present disclosure, and FIG. 25 is a view showing a bar according to another example of the present disclosure;

DETAILED DESCRIPTION

Figure 1:
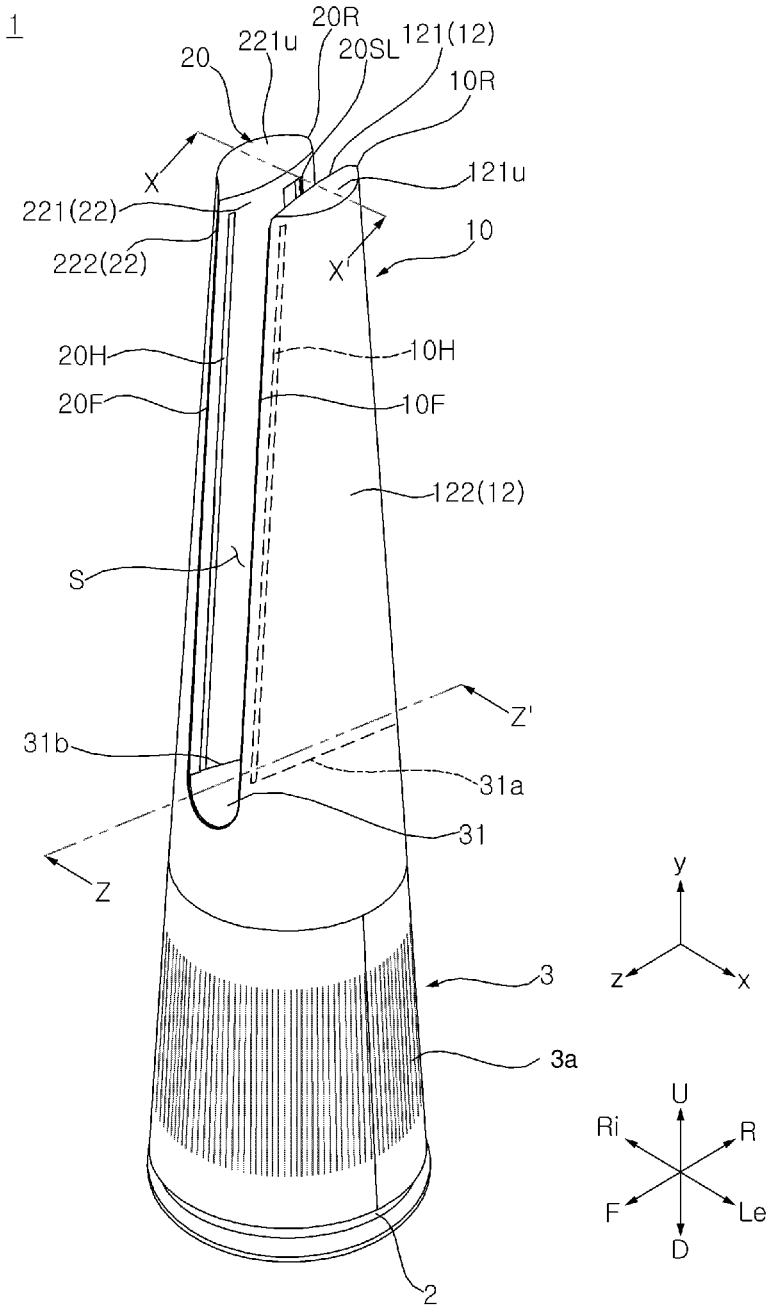
FIG. 1 is a perspective view of a blower according to an embodiment of the present disclosure.

Hereinafter, embodiments disclosed in the present specification will be described in detail with reference to the accompanying drawings, but the same or similar components are assigned the same reference numerals regardless of reference numerals, and redundant description thereof will be omitted.

In the present disclosure, that which is well known to one of ordinary skill in the relevant art has generally been omitted for the sake of brevity. The accompanying drawings are used to assist in easy understanding of various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are only used to distinguish one element from another The direction indications of up (U), down (D), left (Le), right (Ri), front (F), and rear (R) shown in the drawings are only for convenience of description, and the technical concept disclosed in the present specification is not limited thereto.

Referring to FIG. 1, a blower 1 may extend long in the up-down direction. The blower 1 may be also referred to as an air filter, an air conditioner, or an air cleaner. The blower 1 may include a base 2, a lower body 3, and an upper body 10, 20.

The base 2 may form a lower surface of the blower 1 and may be placed on the floor of an indoor space. The base 2 may be formed in a circular plate shape or other shape to correspond to a lower end of the lower body 3 as a whole.

The lower body 3 may be disposed in the upper side of the base 2. The lower body 3 may form the lower portion of a side surface of the blower 1. The lower body 3 may be formed in a cylindrical shape or as a portion of a cone, as a whole. For example, the diameter of the lower body 3 may decrease as it progresses from the lower portion of the lower body 3 to the upper portion. As another example, the diameter of the lower body 3 may be uniformly maintained in the up-down direction. at least one suction hole 3*a* may be formed through the side surface or other portion of the lower body 3. For example, a plurality of suction holes 3*a* may be evenly disposed along the circumferential direction of the lower body 3. In another example, one or more suction holes 3*a* may be formed in another location, such as on a bottom surface adjacent to base 2. Accordingly, air may flow in from the outside of the blower 1 to the inside through the plurality of suction holes 3*a*.

The upper body 10, 20 may be disposed in the upper side of the lower body 3. The upper body 10, 20 may provide a flow path communicating with the inner space of the lower body 3.

Referring to the drawing, for example, the upper body 10, 20 may include a first upper body 10 and a second upper body 20 spaced apart from each other.

As another example, blower 1 may include a single upper body 10 (e.g., second upper body 20 may be omitted). In this case, the upper body 10 may extend long in the up-down direction at the upper side of the lower body 3, or may be formed in the shape of a ring having the form of a circle (ellipse) or track or in the shape of an open ring. The position of the single upper body 10 with respect to the lower body 3 may be determined in consideration of the shape of the upper body 10 and based on other factors, such as the position, shape, and number of slits, as an air discharge hole formed on a surface of the upper body 10.

Hereinafter, for a brief description, an example in which blower 1 includes the first upper body 10 and the second upper body 20 will be described. In addition, the description may be identically applicable even when the second upper body 20 is omitted and only a single upper body 10 is provided, unless the description is applicable only to a case in which the blower 1 includes the two upper bodies 10, 20.

The first upper body 10 and the second upper body 20 may be disposed in the upper side of the lower body 3. The first upper body 10 and the second upper body 20 may form upper side surfaces of the blower 1. The first upper body 10 and the second upper body 20 may extend to be relatively long in the up-down (e.g., vertical) direction and narrow in a horizontal direction, and may be spaced apart from each other in the left-right or other horizontal direction. Meanwhile, the first upper body 10 may be referred to as a first tower or a first nozzle tower, and the second upper body 20 may be referred to as a second tower or a second nozzle tower.

A space S may be formed between the first upper body 10 and the second upper body 20, and may provide an air flow path for blower 1. The space S may be opened in the front-rear direction. The space S may also be opened in an upward direction. Meanwhile, the space S may be referred to as a blowing space, a valley, or a channel.

In an example depicted in drawings, the first upper body 10 may be spaced apart from and to the lift of the second upper body 20. The first upper body 10 may extend long in the up-down direction. The first upper body 10 may include a first panel 12 forming a surface of the first upper body 10. The first panel 12 may include a first inner panel 121 facing the space S and a first outer panel 122 facing the first inner panel 121.

The first inner panel 121 may be convex in a direction from the first upper body 10 toward the space S, i.e., to the right. For example, the first inner panel 121 may extend long in the up-down direction. The first outer panel 122 may be convex in a direction opposite to the direction from the first upper body 10 toward the space S, i.e., to the left. For example, the first outer panel 122 may extend to be inclined by a certain angle (e.g., an acute angle) in a direction toward the space S, that is, to the right with respect to a vertical line extending in the up-down direction.

In this case, the curvature of the first outer panel 122 may be greater than the curvature of the first inner panel 121. In addition, the first outer panel 122 may meet the first inner panel 121 to form an edge. The edge may be provided as a first front end 10F and a first rear end 10R of the first upper body 10. For example, the first front end 10F may extend to be inclined in the rearward direction by a certain angle (e.g., an acute angle) with respect to a vertical line extending in the up-down direction. For example, the first rear end 10R may extend to be inclined in the forward direction by a certain angle (e.g., an acute angle) with respect to a vertical line extending in the up-down direction.

In an example depicted in drawings, the second upper body 20 may be spaced apart from and to the right of the first upper body 10. The second upper body 20 may extend to be relatively long in the up-down (e.g., vertical) direction and relatively narrow in a horizontal direction. The second upper body 20 may include a second panel 22 forming a surface of the second upper body 20. The second panel 22 may include a second inner panel 221 facing the space S, and a second outer panel 222 facing the second inner panel 221.

The second inner panel 221 may be convex in a direction from the second upper body 20 toward the space S, i.e., to the left. For example, the second inner panel 221 may extend long in the up-down direction. The second outer panel 222 may be convex in a direction from the second upper body 20 toward the space S, i.e., to the right. For example, the second outer panel 222 may extend to be inclined by a certain angle (e.g., an acute angle) in a direction toward the space S with respect to a vertical line extending in the up-down direction, i.e., to the left.

In this case, the curvature of the second outer panel 222 may be greater than the curvature of the second inner panel 221. In addition, the second outer panel 222 may meet the first inner panel 221 to form an edge. The edge may be provided as a second front end 20F and a second rear end 20R of the second upper body 20. For example, the second front end 20F may extend in the rearward direction by a certain angle (e.g., an acute angle) with respect to a vertical line extending in the up-down direction. For example, the second rear end 20R may extend in the forward direction by a certain angle (e.g., an acute angle) with respect to a vertical line extending in the up-down direction.

Meanwhile, the first upper body 10 and the second upper body 20 may be symmetrical left and right with the space S interposed therebetween. In addition, the surface of the first outer panel 122 and the surface of the second outer panel 222 may be located on a virtual curved surface extending along the surface of the lower body 3. In other words, the surface of the first outer panel 122 and the surface of the second outer panel 222 may be smoothly connected to the surface of the lower body 3. In addition, the upper surface 121*u* of the first upper body 10 and the upper surface 221*u* of the second upper body 20 may be provided in a horizontal plane. In this case, the blower 1 may be formed in a truncated cone shape as a whole. Thus, the risk of the blower 1 being overturned by an external impact can be lowered since blower 1 has a relatively wider base 2.

A groove 31 may be located between the first upper body 10 and the second upper body 20, and may extend long in the front-rear direction. The groove 31 may be a curved surface that is concave downward. The groove 31 may include a first side 31*a* connected to a lower side of the first inner panel 121 and a second side 31*b* connected to a lower side of the second inner panel 221. The groove 31 may define a boundary of the space S together with the first inner panel 121 and the second inner panel 221. Meanwhile, the groove 31 may be referred to as a connection groove or a connection surface.

Figure 2:
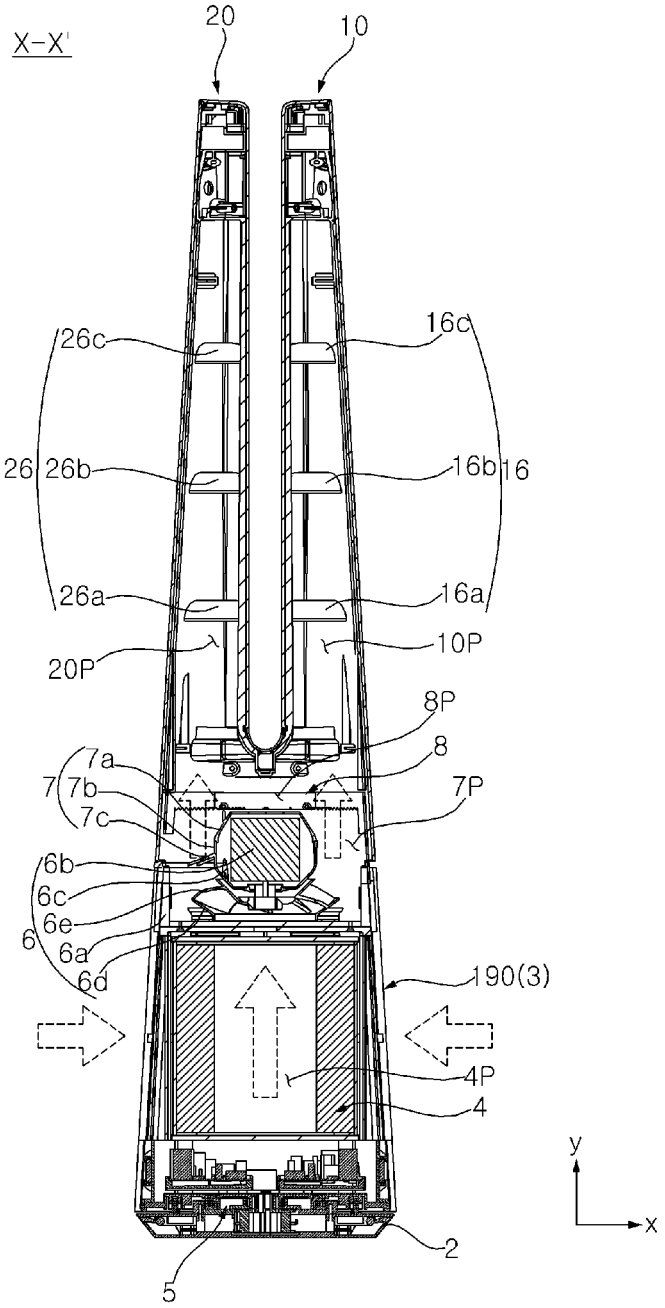
FIG. 2 is a cross-sectional view taken along line X-X' of FIG. 1.

Referring to FIG. 2, the lower body 3 may provide an internal space in which a filter 4, a controller 5, a fan 6, and an air guide 7 described later are installed. It should be appreciated, however, that one or more of filter 4, controller 5, fan 6, and/or air guide 7 may be provide outside of the lower body 3, such as in upper body 10, 20.

The filter 4 may be detachably installed in the inner space of the lower body 3. The filter 4 may be formed in a substantially cylindrical shape. For example, the filter 4 may include a hole 4P formed to extend through the filter 4 in the up-down direction. The filter 4 may include a ring-shaped lower frame 4*a* forming the lower end of the filter 4 and a ring-shaped upper frame 4*b* forming the upper end of the filter 4 (refer to FIG. 13). The air may flow into the inside of the lower body 3 through the suction hole 3*a* (refer to FIG. 1) by the operation of the fan 6. In addition, the air flowing into the inside of the lower body 3 may flow from the outer circumferential surface of the filter 4 to the inner circumferential surface and be purified, and may flow to the upper side of the filter 4 through the hole 4P.

The controller 5 may be installed in the inner space of the lower body 3. The controller 5 may be electrically connected to various components of the blower 1 and may control the operation of the blower 1.

The fan 6 may be installed in the inner space of the lower body 3, and may be disposed above the filter 4. The fan 6 may cause air to flow into the inside of the blower 1 and then be discharged to the outside of the blower 1. The fan 6 may include one or more of a fan housing 6*a*, a fan motor 6*b*, a hub 6*c*, a shroud 6*d*, and a blade 6*e*. Meanwhile, the fan 6 may be referred to as a fan assembly or a fan module.

The fan housing 6*a* may form an outer shape of the fan 6. The fan housing 6*a* may have a cylindrical shape. A bell mouth (or tapered opening) 6*f* may be located in the lower end of the fan housing 6*a*. A suction port may be formed in an interior of the bell mouth 6*f* and may provide air to the shroud 6*d*, to be described later.

The fan motor 6*b* may provide a rotational force. The fan motor 6*b* may be a centrifugal fan or a mixed flow fan motor. The fan motor 6*b* may be supported by a motor cover 7*b*, to be described later. In this case, the rotation shaft of the fan motor 6*b* may extend from the fan motor 6*b* and to the lower side of the fan motor 6*b*, and may penetrate the lower surface of the motor cover 7*b*. The hub 6*c* may be fixed to the rotation shaft and rotate together with the rotation shaft. The shroud 6*d* may be spaced from the hub 6*c* to the outer side of the hub 6*c*. A plurality of blades 6*e* may be disposed between the hub 6*c* and the shroud 6*d*. Accordingly, when the fan motor 6*b* is driven, air may flow in the axial direction of the fan motor 6*b* through the suction port, and may be discharged in the radial direction of the fan motor 6*b* and to the upper side thereof.

The air guide 7 may be disposed in the upper side of the fan 6, i.e., downstream of the fan 6, and the air guide 7 may provide a flow path 7P through which air discharged from the fan 6 flows. For example, the flow path 7P may be an annular flow path. The air guide 7 may include one or more of a guide body 7*a*, a motor cover 7*b*, or a vane 7*c*. Meanwhile, the air guide 7 may be referred to as a diffuser.

The guide body 7*a* may form the outer shape of the air guide 7. The motor cover 7*b* may be disposed in a central portion of the air guide 7. For example, the guide body 7*a* may be formed in a cylindrical shape. In one example, the motor cover 7*b* may be formed in a bowl shape. In this case, the aforementioned annular flow path 7P may be formed between the guide body 7*a* and the motor cover 7*b*. The plurality of vanes 7*c* may be disposed in the annular flow path 7P, and may be spaced apart from each other in the circumferential direction of the guide body 7*a*. Each of the plurality of vanes 7*c* may extend from the outer surface of the motor cover 7*b* to the inner circumferential surface of the guide body 7*a*. Accordingly, the plurality of vanes 7*c* may guide the air provided from the fan 6 to the flow path 7P to the upper side of the air guide 7.

A distribution unit 8 may be disposed between the air guide 7 and the upper body 10, 20. The distribution unit 8 may provide a flow path 8P through which the air passing through the air guide 7 flows. The air passing through the air guide 7 may be distributed to the first upper body 10 and the second upper body 20 through the distribution unit 8. Meanwhile, the distribution unit 8 may be also referred to as a splitter, a middle body, an inner body, a tower base, or a nozzle tower base.

The first upper body 10 may include a first flow path 10P through which a portion of the air that has passed through the air guide 7 and the distribution unit 8 flows. The first flow path 10P may be formed in the inner space of the first upper body 10. The second upper body 20 may include a second flow path 20P through which the remainder of the air that has passed through the air guide 7 and the distribution unit 8 flows. The second flow path 20P may be formed in the inner space of the second upper body 20. For example, the first flow path 10P and the second flow path 20P may communicate with the flow path 8P of the distribution unit 8 and the flow path 7P of the air guide 7.

Figure 3:
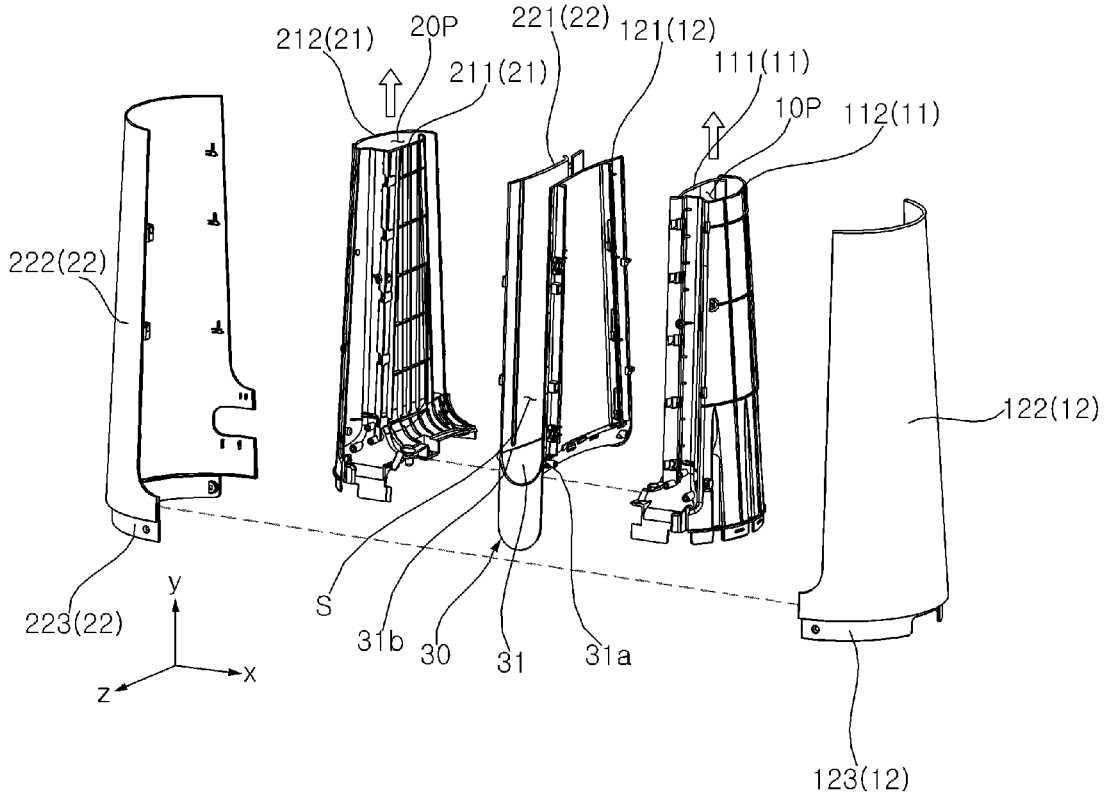
FIG. 3 is an exploded perspective view of a first upper body and a second upper body of a blower according to an embodiment of the present disclosure.

Referring to FIGS. 1 and 3, the first upper body 10 may include a first wall 11, in addition to the first inner panel 121 and the first outer panel 122 described above. The first wall 11 may be located between the first inner panel 121 and the first outer panel 122. For example, the first panel 12 may surround the first wall 11. The first wall 11 may include a first inner wall 111 facing the inner side of the first inner panel 121 and a first outer wall 112 facing the inner side of the first outer panel 122.

The first inner wall 111 may be detachably coupled to the inner side of the first inner panel 121. The first outer wall 112 may be detachably coupled to the inner side of the first outer panel 122. The first inner wall 111 and the first outer wall 112 may be coupled to each other and may form the first flow path 10P. In addition, the first inner panel 121 may be coupled to or fixed to a groove body 30 having the groove 31. Accordingly, the first panel 12 may form a surface of the first upper body 10, and the first wall 11 may provide a first flow path 10P through which air flows.

The second upper body 20 may include a second wall 21, in addition to the second inner panel 221 and the second outer panel 222 described above. The second wall 21 may be located between the second inner panel 221 and the second outer panel 222. For example, the second panel 22 may surround the second wall 21. The second wall 21 may include a second inner wall 211 facing the inner side of the second inner panel 221 and a second outer wall 212 facing the inner side of the second outer panel 222.

The second inner wall 211 may be detachably coupled to the inner side of the second inner panel 221. The second outer wall 212 may be detachably coupled to the inner side of the second outer panel 222. The second inner wall 211 and the second outer wall 212 may be coupled to each other and form a second flow path 20P. In addition, the second inner panel 221 may be coupled to or fixed to the groove body 30 having the groove 31. Accordingly, the second panel 22 may form a surface of the second upper body 20, and the second wall 21 may provide a second flow path 20P through which air flows.

Figure 4:
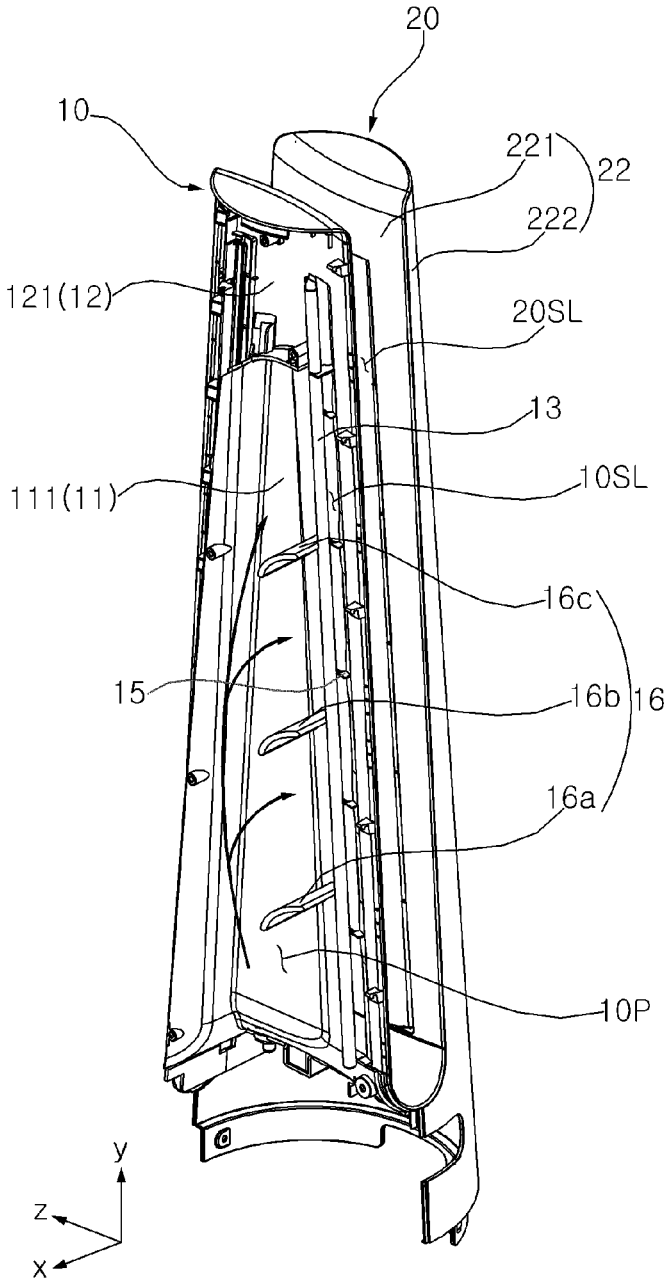
FIG. 4 is a perspective view illustrating a state in which a first outer panel is separated from a first upper body of a blower according to an embodiment of the present disclosure.

Referring to FIG. 4, a first vane 16 may be installed in the first flow path 10P. The first vane 16 may be coupled to the inner side of the first wall 11. For example, the first vane 16 may be located between the first inner wall 111 and the first outer wall 112 (refer to FIG. 3), and the right end of the first vane 16 may be coupled or fixed to the inner surface of the first inner wall 111.

The first vane 16 may be adjacent to a first slit 10SL of the first upper body 10 described later. The first vane 16 may have a convex shape. The rear end of the first vane 16 may be located in the upper side of the front end of the first vane 16. For example, the first vane 16 may include a plurality of first vanes 16*a*, 16*b*, and 16*c* spaced apart from each other in the up-down direction.

Figure 5:
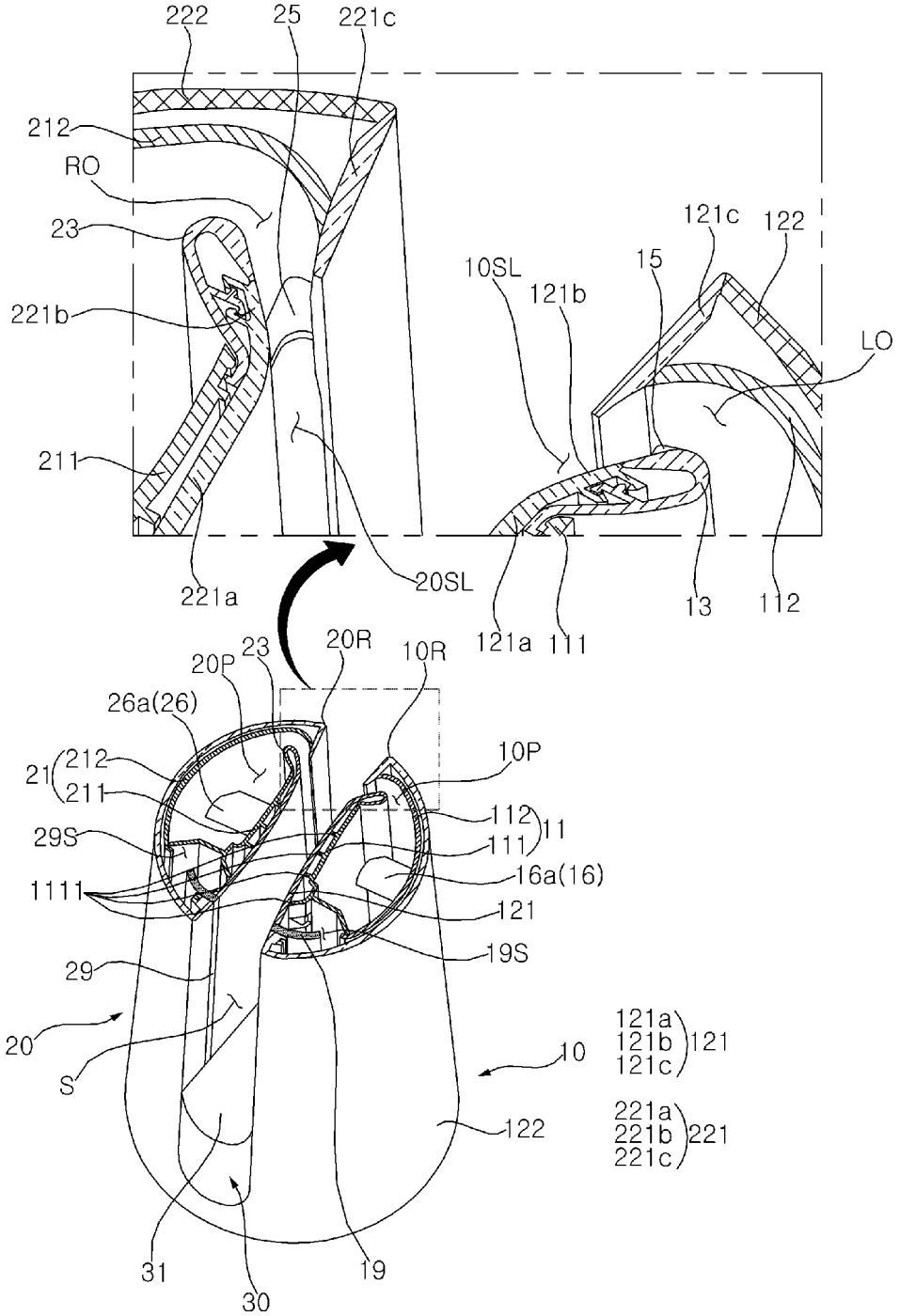
FIG. 5 is a perspective view illustrating an internal configuration of a portion of the first upper body and the second upper body of the blower by cutting out the portion according to an embodiment of the present disclosure.

Meanwhile, a second vane 26, 26*a* may be installed in the second flow path 20P, and the above-described contents of the first vane 16 may be substantially identically applied to the second vane 26, 26*a* (refer to FIG. 5). Accordingly, the first vane 16 may smoothly guide the air rising in the first flow path 10P in the rearward direction. In addition, the second vane 26 may smoothly guide the air rising in the second flow path 20P in the rearward direction.

Referring to FIG. 5, a first connecting member 13 may be located in the first flow path 10P, and the rear end of the first vane 16 may be connected thereto. The first connecting member 13 may extend from the first inner wall 111 to be inclined to the left toward the rearward direction. In addition, the first connecting member 13 may be adjacent to the first rear end 10R of the first upper body 10, and may be spaced apart from the first outer wall 112. In this case, a portion of a first opening LO may be located between the first connecting member 13 and the first outer wall 112, and may be inclined to the right toward the forward direction. Here, the first opening LO may communicate with the first flow path 10P. Meanwhile, the first opening LO may be referred to as a first discharge port or a first mouse. Accordingly, the air flowing through the first flow path 10P may be guided in the rearward direction by the first vane 16, and may flow into an inlet of the first opening LO.

The first slit 10SL may be adjacent to the first rear end 10R of the first upper body 10, and may be formed through the first inner panel 121. The first slit 10SL may extend long along the first rear end 10R of the first upper body 10. The first slit 10SL may be an outlet of the first opening LO. Accordingly, the first slit 10SL may discharge the air flowing through the first flow path 10P to the space S. Meanwhile, the first slit 10SL may be referred to as a first discharge hole.

A second connecting member 23 may be located in the second flow path 20P, and the rear end of the second vane 26 may be connected thereto. The second connecting member 23 may extend from the second inner wall 211 to be inclined to the right toward the rearward direction. In addition, the second connecting member 23 may be adjacent to the second rear end 20R of the second upper body 20, and may be spaced apart from the second outer wall 212. In this case, a portion of a second opening RO may be located between the second connecting member 23 and the second outer wall 212, and may be inclined to the left toward the forward direction. Here, the second opening RO may communicate with the second flow path 20P. Meanwhile, the second opening RO may be referred to as a second discharge port or a second mouse. Accordingly, the air flowing through the second flow path 20P may be guided in the rearward direction by the second vane 26 and may flow into the inlet of the second opening RO.

A second slit 20SL may be adjacent to the second rear end 20R of the second upper body 20, and may be formed to penetrate the second inner panel 221. The second slit 20SL may extend long along the second rear end 20R of the second upper body 20. The second slit 20SL may be an outlet of the second opening RO. Accordingly, the second slit 20SL may discharge the air flowing through the second flow path 20P to the space S. Meanwhile, the second slit 20SL may be referred to as a second discharge hole.

For example, the first connecting member 13 and the second connecting member 23 may be symmetrical left and right, and the first slit 10SL and the second slit 20SL may face each other. In this case, the first opening LO may be inclined or bent in the forward direction of the second slit 20SL. In addition, the second opening RO may be inclined or bent in the forward direction of the first slit 10SL. Meanwhile, the first slit 10SL and the second slit 20SL may be hidden from a user's gaze looking from the forward direction to the rearward direction of the blower 1 (refer to FIG. 1).

A first slot 10H (refer to FIG. 1) may be adjacent to the first front end 10F of the first upper body 10, and may be formed to penetrate the first inner panel 121. The first slot 10H may be formed to extend long along the first front end 10F. A first damper 19 may be installed in a first space 19S and may extend long along the first slot 10H. The first damper 19 may have an arc-shaped lateral cross-section. A first moving assembly may be installed in the first space 19S and may move the first damper 19 in the circumferential direction of the first damper 19. Accordingly, the first damper 19 may close the first slot 10H and may pass through the first slot 10H.

A second slot 20H (refer to FIG. 1) may be adjacent to the second front end 20F of the second upper body 20 and may be formed to penetrate the second inner panel 221. A second slot 20H may be formed to extend long along the second front end 20F. A second damper 29 may be installed in a second space 29S and may extend long along the second slot 20H. The second damper 29 may have an arc-shaped lateral cross-section. A second moving assembly (not shown) may be installed in the second space 29S, and may move the second damper 29 in the circumferential direction of the second damper 29. Accordingly, the second damper 29 may close the second slot 20H, and may pass through the second slot 20H.

In one example, the second damper 29 may be symmetrical with the first damper 19. In addition, the second moving assembly may be symmetrical with the first moving assembly. In one example, the first or second moving assembly may have a rack-pinion coupling structure, a pulley-belt coupling structure, a link coupling structure, or the like that can transmit the rotational force of electric motor to the first or second damper 19, 29. For another example, the first or second moving assembly may have a connecting structure, or the like that can transmit the driving force of actuator to the first or second damper 19, 29.

Meanwhile, the second slot 20H, the second damper 29 and the second moving assembly may be omitted. In this case, the first damper 19 may move toward or away from the second upper body 20. For example, a distal end of the first damper 19 at a first position may be adjacent to or parallel to the surface of the first inner panel 121. For example, a distal end of the first damper 19 at a second position may be adjacent to or in contact with the second inner panel 221 of the second upper body 20. The first damper 19 may move between the first position and the second position.

Alternatively, the first slot 10H, the first damper 19 and the first moving assembly may be omitted. In this case, the second damper 29 may move toward or away from the first upper body 10. For example, a distal end of the second damper 29 at a first position may be adjacent to or parallel to the surface of the second inner panel 221 of the second upper body 20. For example, a distal end of the second damper 29 at a second position may be adjacent to or in contact with the first inner panel 121 of the first upper body 10. The second damper 29 may move between the first position and the second position.

Figure 6:
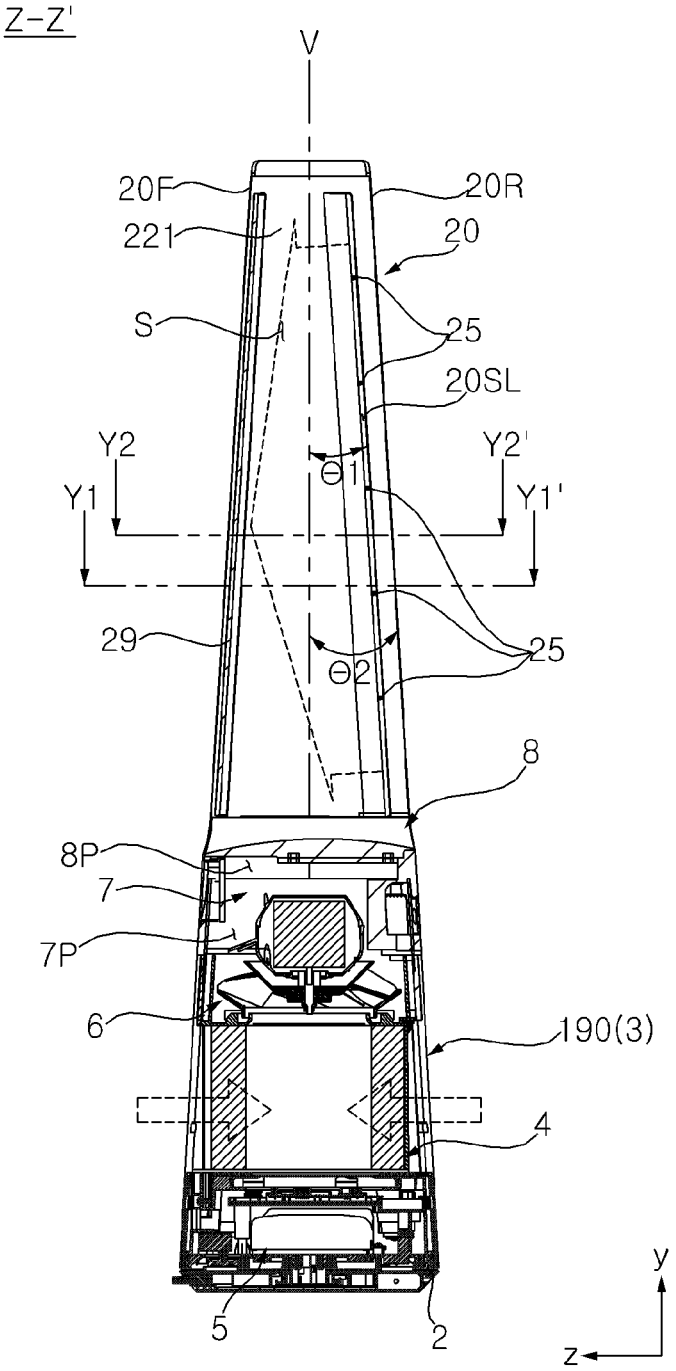
FIG. 6 is a cross-sectional view taken along line Z-Z' of FIG. 1.

Referring to FIGS. 5 and 6, the second slit 20SL may discharge air flowing through the second flow path 20P into the space S. The second slit 20SL may be formed adjacent to the second rear end 20R of the second upper body 20, and penetrate the second inner panel 221. The second slit 20SL may extend long along the second rear end 20R. In this case, the second slit 20SL may be inclined at a certain angle (acute angle) in a forward direction with respect to a vertical line V extending in the up-down direction.

For example, the second slit 20SL may be parallel to the second rear end 20R. As another example, the second slit 20SL may not be parallel to the second rear end 20R. In this case, the second slit 20SL may be inclined at a first angle (Θ1, e.g. 4 degrees) with respect to the vertical line V, and the second rear end 20R may be inclined at a second angle (Θ2, e.g. 3 degrees) smaller than the first angle (Θ1) with respect to the vertical line V. Meanwhile, the first slit 10SL and the second slit 20SL may be symmetrical while facing each other in the left-right direction.

Figure 7:
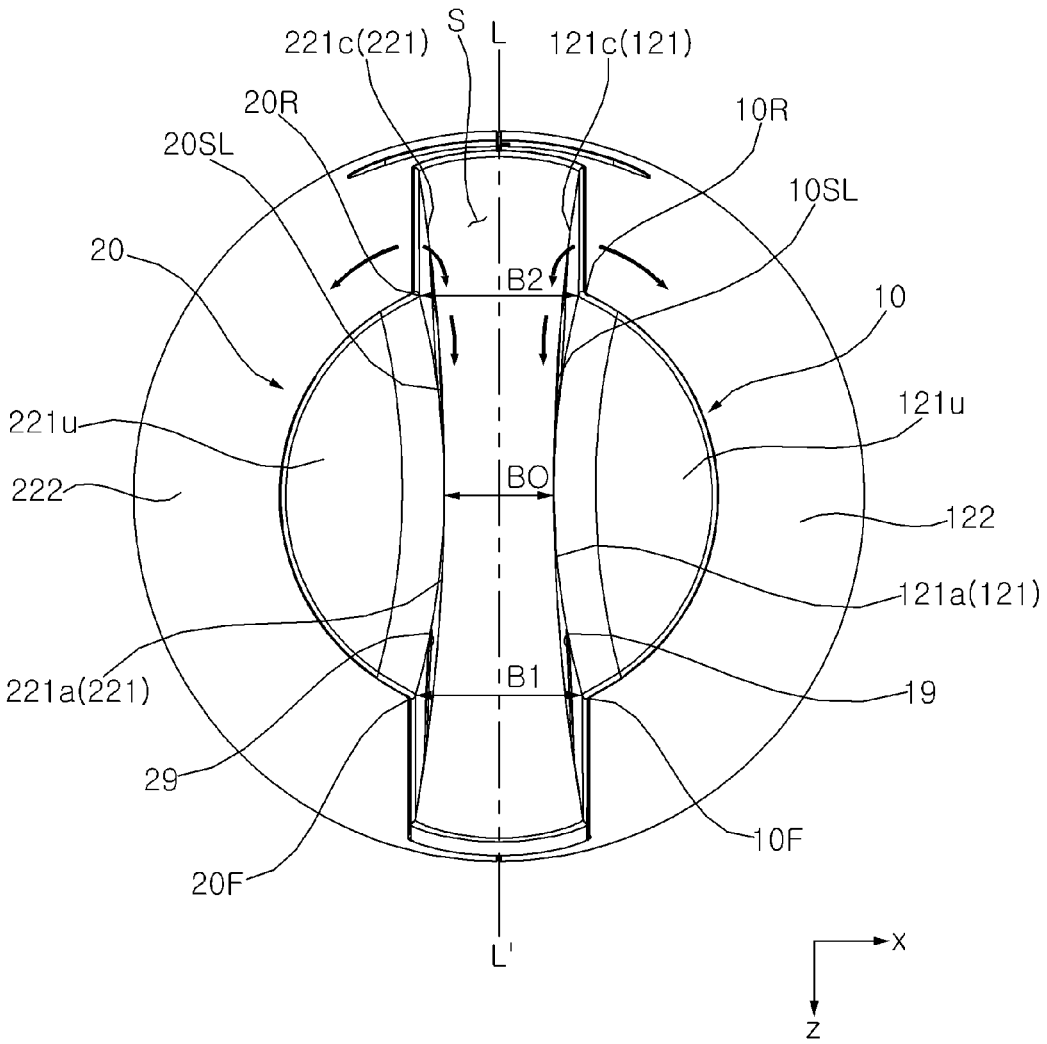
FIGS. 7 and 8 are views for explaining a diffusion airflow formed in a first state of a blower according to an embodiment of the present disclosure.

Referring to FIG. 7, the first inner panel 121 and the second inner panel 221 may face each other, and form left and right boundaries of the space S. A gap between the first inner panel 121 and the second inner panel 221 may decrease as it progresses from the rearward direction to the forward direction and then increase again. The gap may be the width of the space S.

A first gap B1 may be defined as a gap between the first front end 10F of the first upper body 10 and the second front end 20F of the second upper body 20. A second gap B2 may be defined as a gap between the first rear end 10R of the first upper body 10 and the second rear end 20R of the second upper body 20. The second gap B2 may be the same as or different from the first gap G1. A reference gap B0 may be the smallest of the gaps between the first inner panel 121 and the second inner panel 221.

Figure 8:
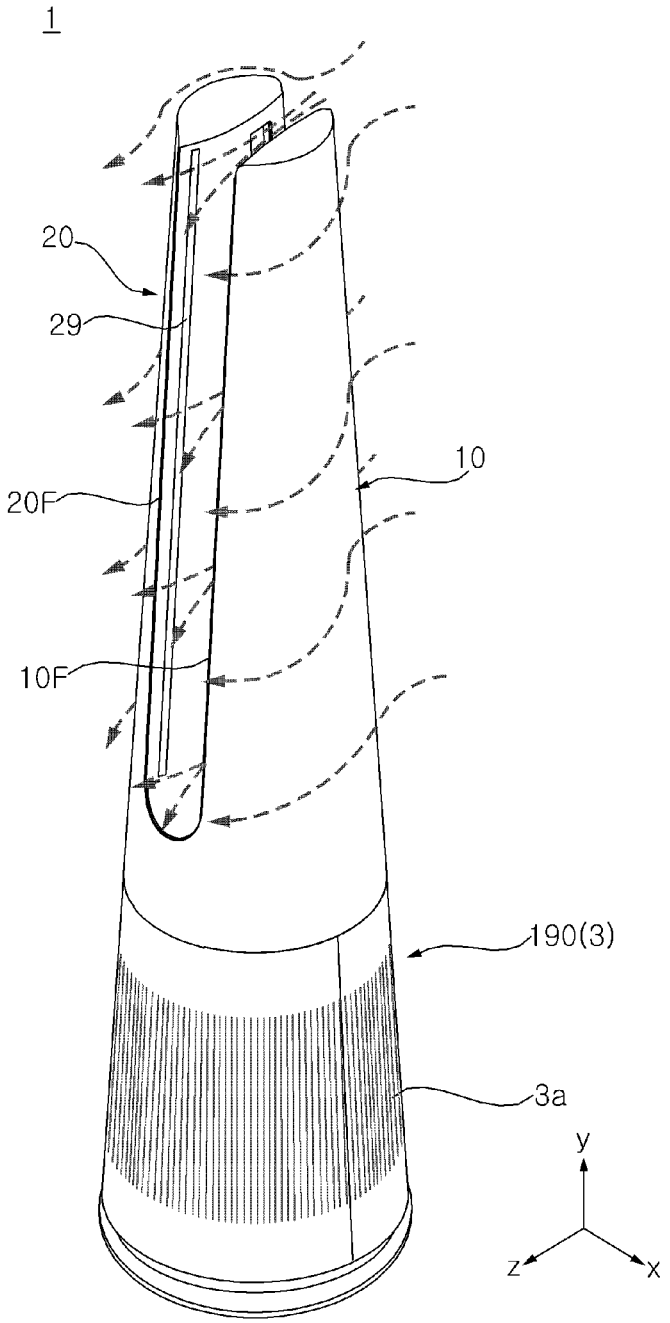

Referring to FIGS. 7 and 8, in the first state of the blower 1, the distal end of the first damper 19 may be inserted or hidden in the first slot 10H, and the distal end of the second damper 29 may be inserted or hidden in the second slot 20H. In this state, the distal end of the first damper 19 may form a surface continuous with the surface of the first inner panel 121, and the distal end of the second damper 29 may form a surface continuous with the surface of the second inner panel 221. Meanwhile, the distal end of the first damper 19 may be inserted or hidden in the first slot 10H, the second damper 29 may be omitted, and the second slot 20H may be closed. Alternatively, the distal end of the second damper 29 may be inserted or hidden in the second slot 20H, the first damper 19 may be omitted, and the first slot 10H may be closed.

Air may be discharged from the first slit 10SL and the second slit 20SL to the space S, in response to the operation of the fan 6 (refer to FIG. 2). In addition, the air discharged to the space S may flow in the forward direction along the surface of the first inner panel 121 and the surface of the second inner panel 221.

This air flow may form an air current that allows the air around the upper body 10, 20 to be entrained into the space S or to move in the forward direction along the surface of the first outer panel 122 and the surface of the second outer panel 222. Accordingly, the blower 1 can provide an air current of abundant airflow to a user or the like.

Figure 9:
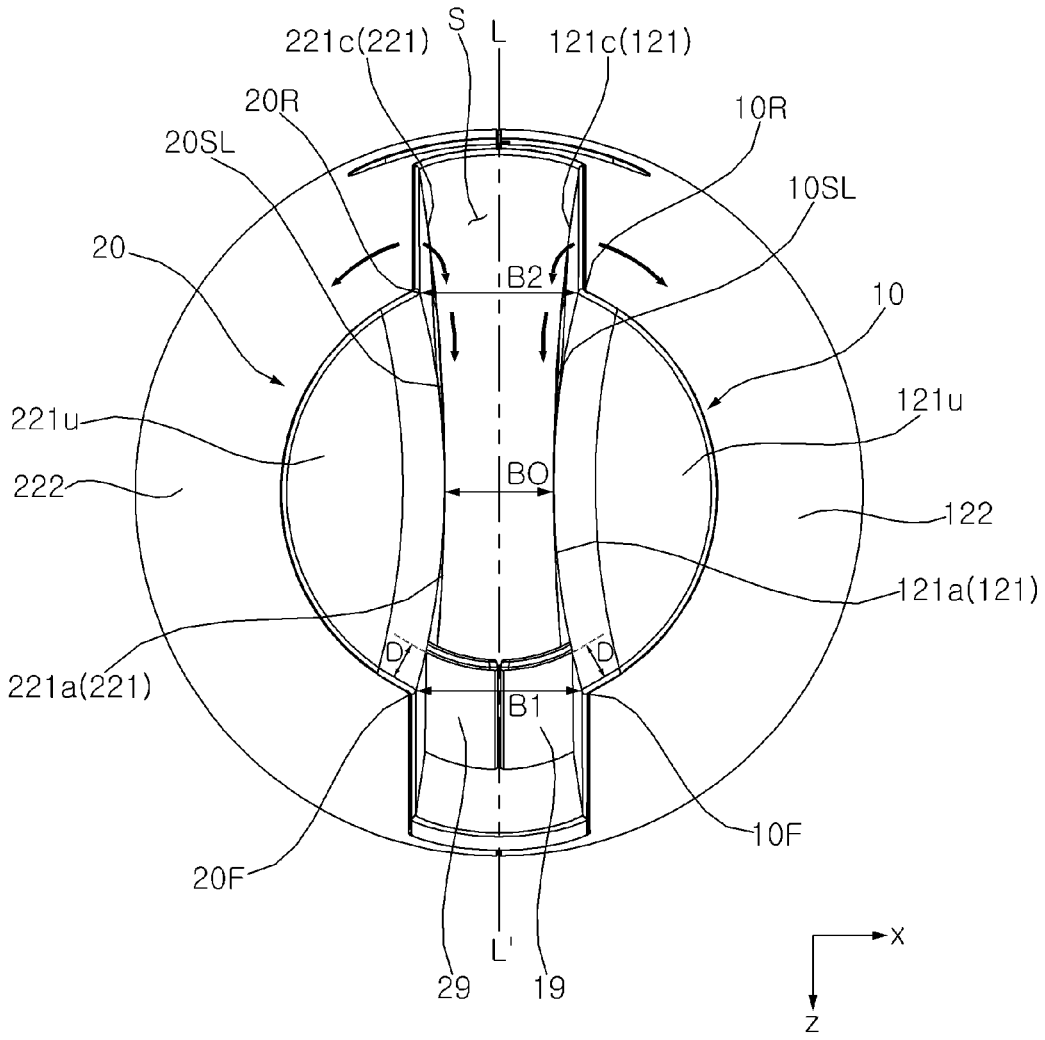
FIGS. 9 and 10 are views for explaining an upward airflow formed in a second state of the blower according to an embodiment of the present disclosure.
Figure 10:
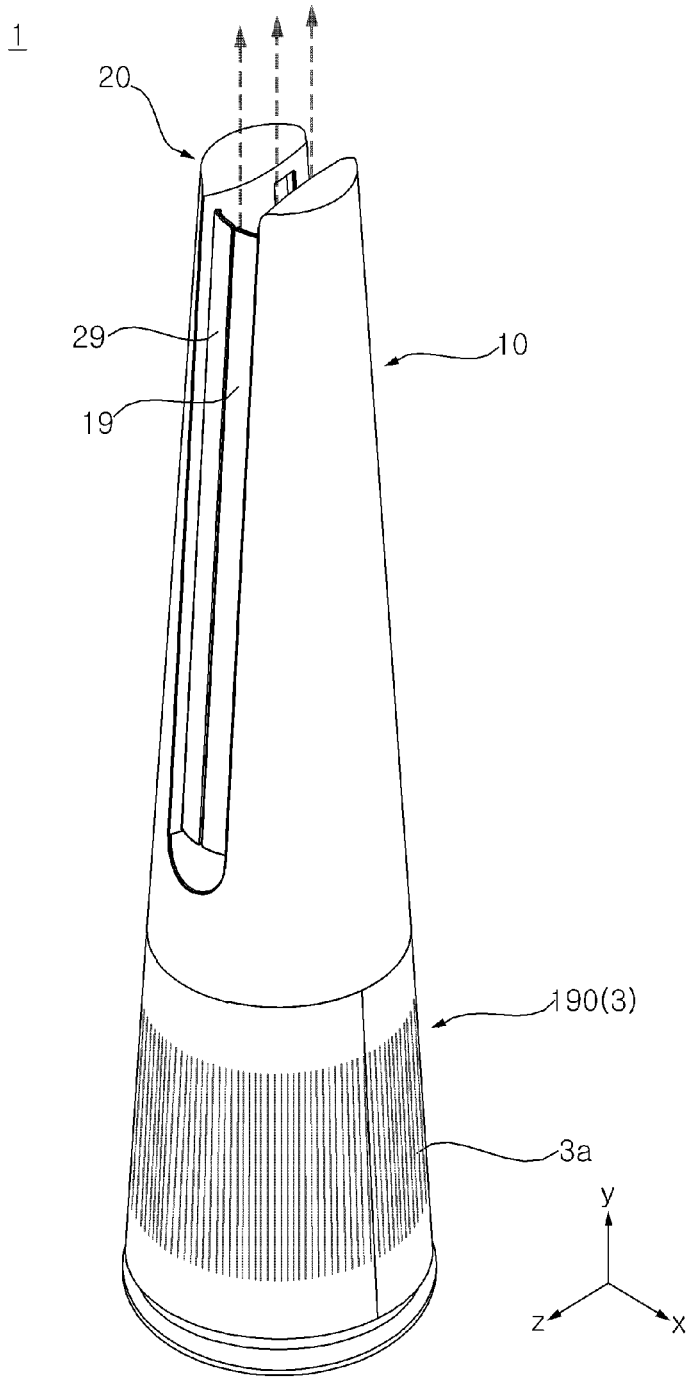

Referring to FIGS. 9 and 10, in the second state of the blower 1, a portion of the first damper 19 may pass through the first slot 10H and may be located in the space S, and a portion of the second damper 29 may pass through the second slot 20H and may be located in the space S. In this example, the distal end of the first damper 19 and the distal end of the second damper 29 may be in contact with or adjacent to each other (e.g., to block space S). In another example, a distance between the distal end of the first damper 19 and the distal end of the second damper 29 may be spaced apart vary (e.g., to partially block space S). Meanwhile, a part of the first damper 19 may be positioned in the space S through the first slot 10H, the second damper 29 may be omitted, and the second slot 20H may be closed. Alternatively, a part of the second damper 29 may be positioned in the space S through the second slot 20H, the first damper 19 may be omitted, and the first slot 10H may be closed.

Air may be discharged from the first slit 10SL and the second slit 20SL into the space S, in response to the operation of the fan 6 (refer to FIG. 2). Then, the air discharged into the space S may flow in the forward direction along the surface of the first inner panel 121 and the surface of the second inner panel 221, and then may be obstructed by the first damper 19 and the second damper 29 and may ascend upwards. Accordingly, the blower 1 may provide an upward airflow, and may circulate air in the indoor space in which the blower 1 is installed.

Figure 11:
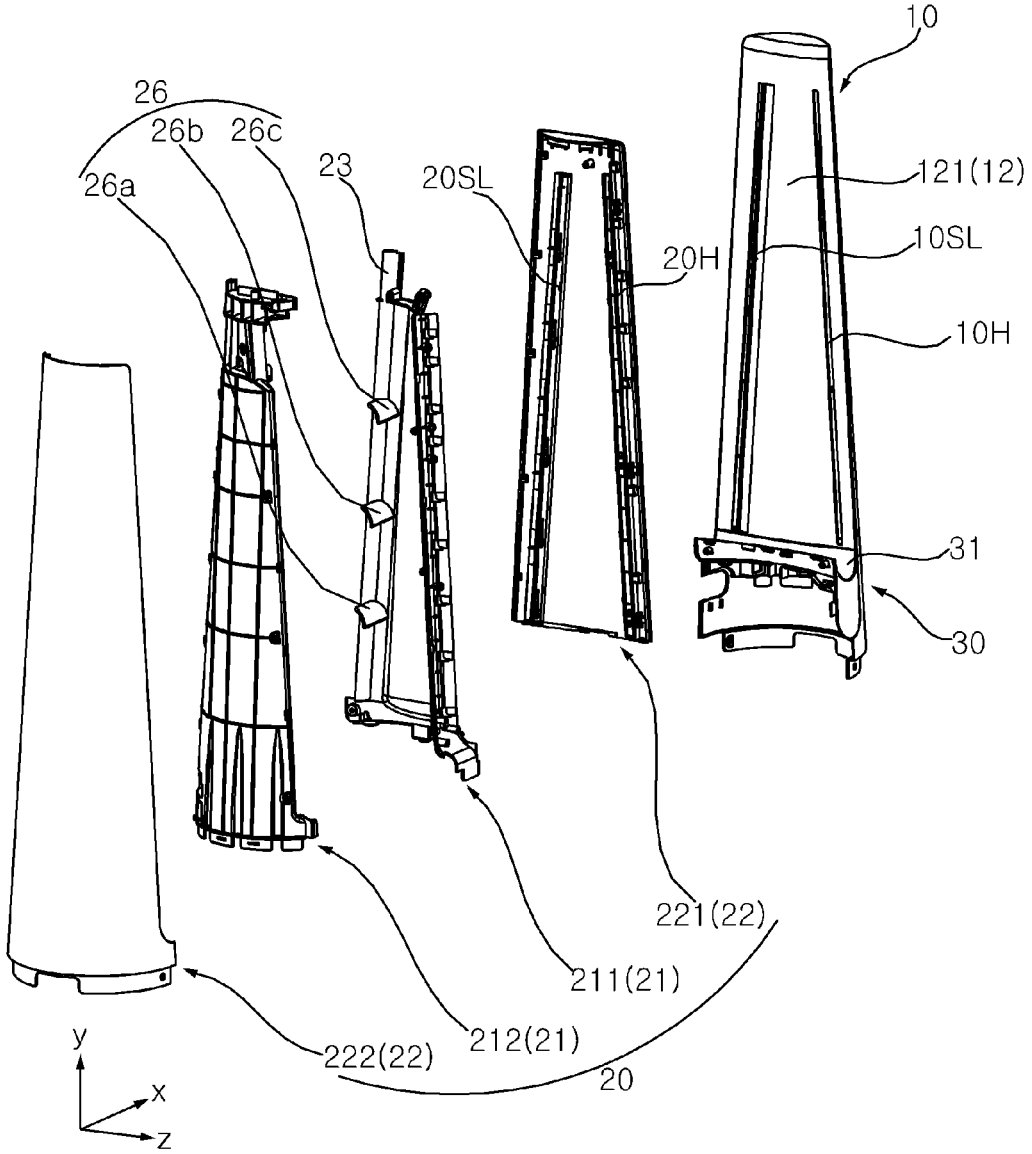
FIG. 11 is an exploded perspective view of a second upper body according to an embodiment of the present disclosure.
Figure 12:
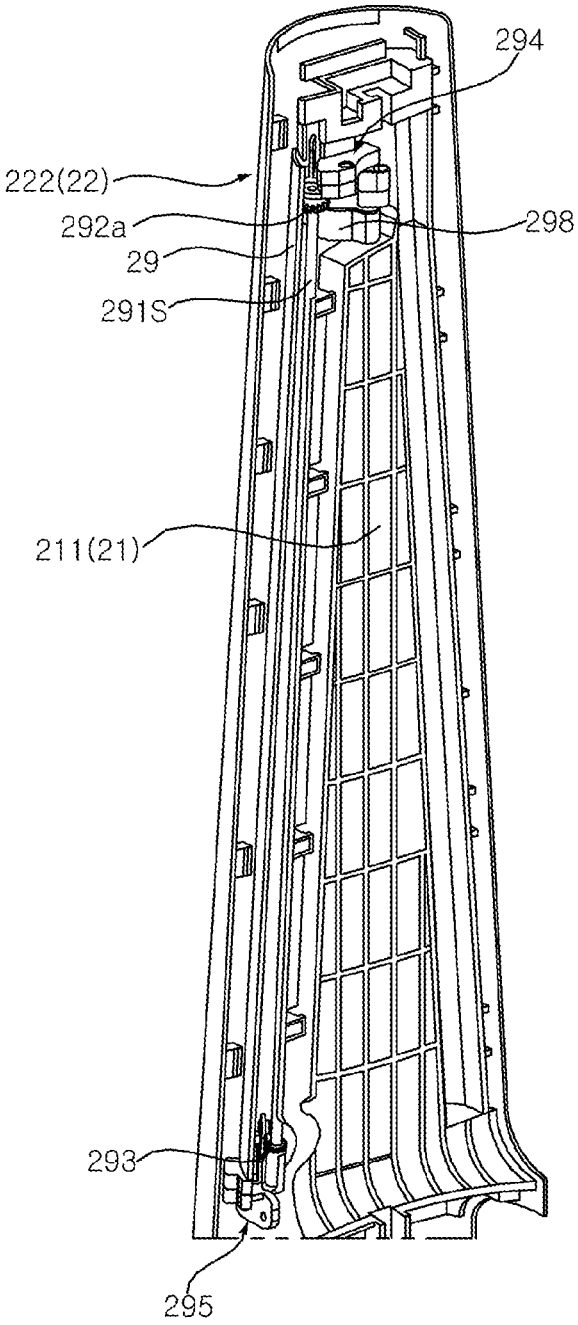
FIG. 12 is a view illustrating a state in which a second inner panel of a second upper body is removed according to an embodiment of the present disclosure.

Referring to FIGS. 11 and 12, the second damper 29 may extend long along the second slot 20H. The second damper 29 may be disposed in the second space 29S (refer to FIG. 5), which is a space between the second wall 21 and the second panel 22, and may penetrate the second slot 20H.

The description of the second damper 29 described above and below, the configuration for moving the second damper 29, and the configuration coupled with the second damper 29 may be also applied to the first damper 19 (refer to FIG. 5), the configuration for moving the first damper 19, and the configuration coupled with the first damper 19.

Figure 13:
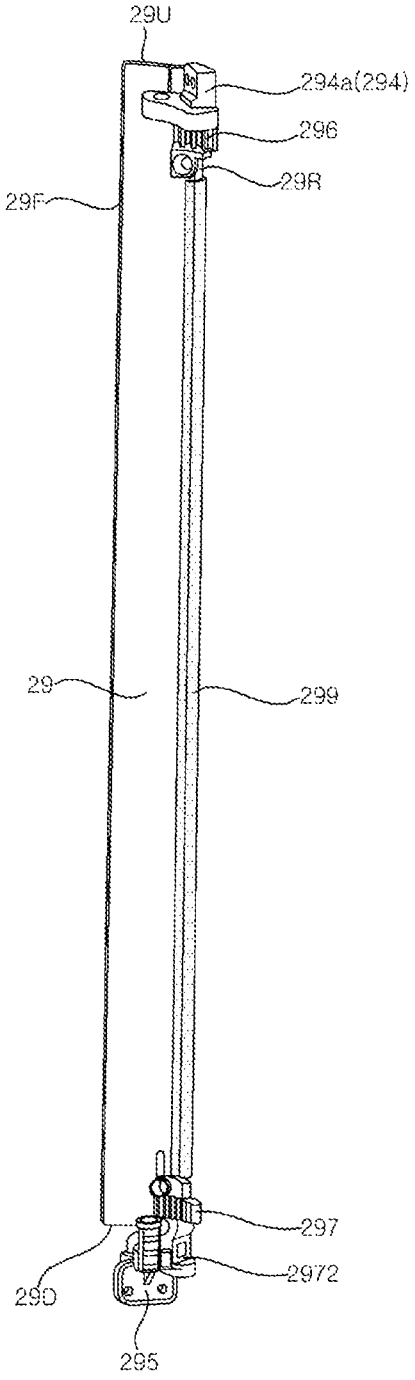
FIG. 13 is a perspective view of a second damper and a second bar coupled thereto as viewed from the inside of a second damper according to an embodiment of the present disclosure.

Referring to FIG. 13, the length of the second damper 29 may be greater than the width of the second damper 29. For example, the length of the second damper 29 may be approximately 15 times greater than the width of the second damper 29.

An upper end 29U of the second damper 29 may be referred to as a first short side, and a lower end 29D of the second damper 29 may be referred to as a second short side. A front end 29F of the second damper 29 may be referred to as a first long side, and a rear end 29R of the second damper 29 may be referred to as a second long side. In the second state of the blower 1 described above with reference to FIGS. 9 and 10, the front end 29F of the second damper 29 may contact the front end of the first damper 19.

An upper holder 296 may be adjacent to an intersection of the upper end 29U and the rear end 29R of the second damper 29, and may be fixed to the inner surface of the second damper 29. A lower holder 297 may be adjacent to an intersection of the lower end 29D and the rear end 29R of the second damper 29, and may be fixed to the inner surface of the second damper 29.

Figure 14:
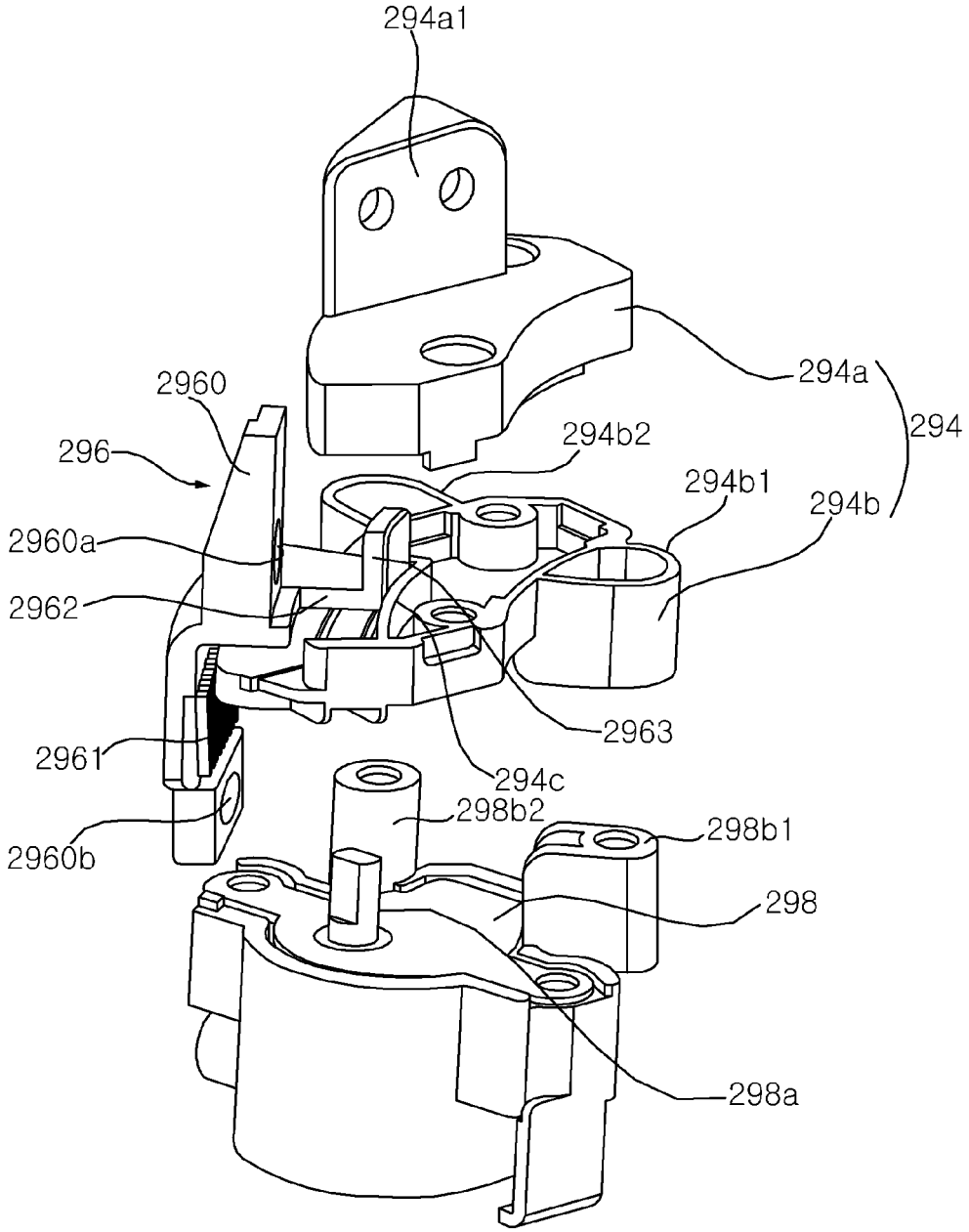
FIGS. 14 to 17 are views for explaining an upper configuration of a second moving assembly according to an embodiment of the present disclosure.

Referring to FIG. 14, the upper holder 296 may include an upper fixing portion (or upper fixing wall) 2960, an upper rack 2961, an upper horizontal rib 2962, and an upper vertical rib 2963. Upper fixing hole 2960*a*, 2960*b* may be formed to penetrate the upper fixing portion 2960. A fastening member such as a screw may penetrate the upper fixing hole 2960*a*, 2960*b* to be fastened to the inner surface of the second damper 29 (refer to FIG. 13).

The upper rack 2961 may be formed on the inner surface of the upper fixing portion 2960. The upper rack 2961 may be located between a first upper fixing hole 2960*a* and a second upper fixing hole 2960*b*. The upper rack 2961 may be bent along the curvature of the second damper 29 (refer to FIG. 5).

The upper horizontal rib 2962 may protrude from the inner surface of the upper fixing portion 2960 in a horizontal direction. The upper horizontal rib 2962 may be located in the upper side of the upper rack 2961.

The upper vertical rib 2963 may extend upwardly from the distal end of upper horizontal rib 2962. The upper vertical rib 2963 may be bent along the curvature of the upper rack 2961.

Figure 15:
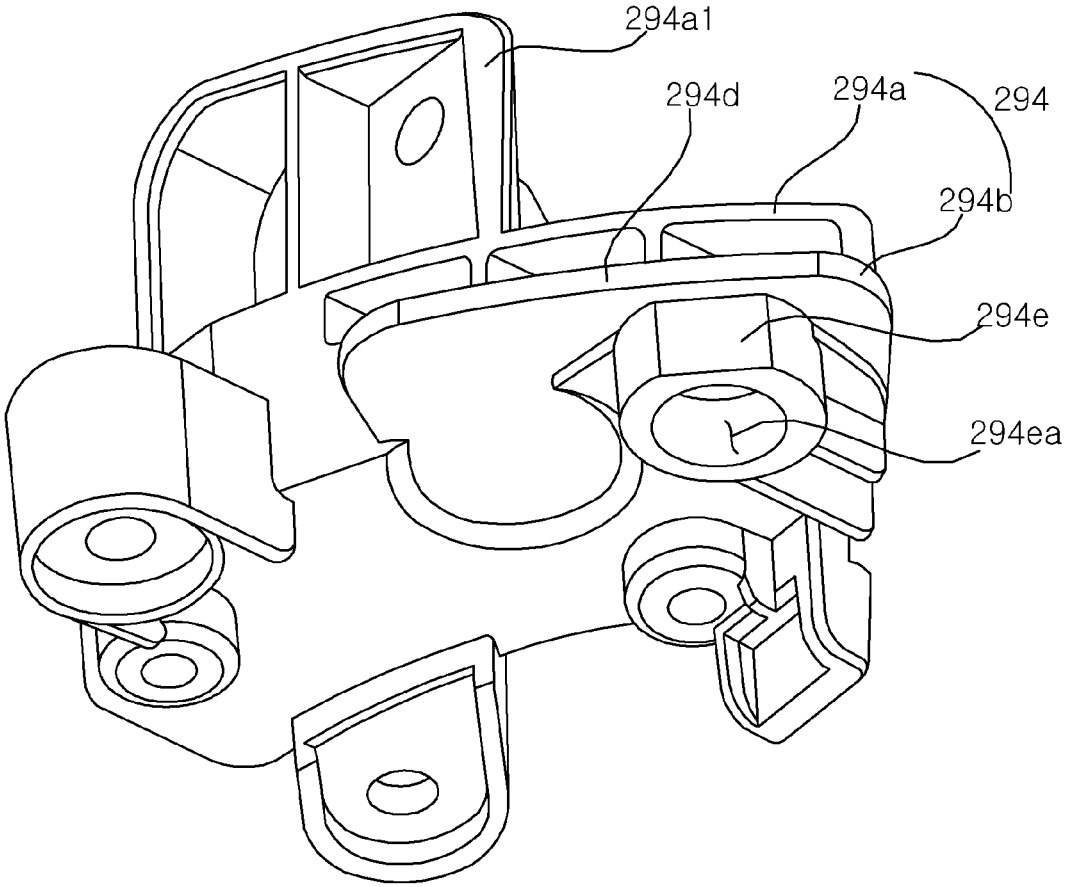

Referring to FIGS. 14 and 15, the upper guide 294 may include one or more of a first upper guide 294*a* and a second upper guide 294*b*. A mount 294*a*1 of the first upper guide 294*a* may be fixed to the outer surface of the second wall 21 in the second space 29S (refer to FIG. 5) (refer to FIG. 17). For example, an upper guide groove may be formed on the lower surface of the first upper guide 294*a*, and may guide the movement of the upper vertical rib 2963.

The second upper guide 294*b* may face the first upper guide 294*a* with respect to the upper vertical rib 2963. The second upper guide 294*b* may be detachably coupled to the first upper guide 294*a*. For example, the upper guide rib 294*c* may be formed on the upper surface of the second upper guide 294*b* and may guide the movement of the upper vertical rib 2963. In this case, the upper guide rib 294*c* may be bent along the curvature of the upper vertical rib 2963. In addition, the second upper guide 294*b* may include a plate 294*d* supporting the lower surface of the upper horizontal rib 2962.

Meanwhile, a first shaft holder 294*e* may protrude downward from the lower surface of the second upper guide 294*b*. A first hole 294*ea* may be formed inside the first shaft holder 294*e*.

Figure 16:
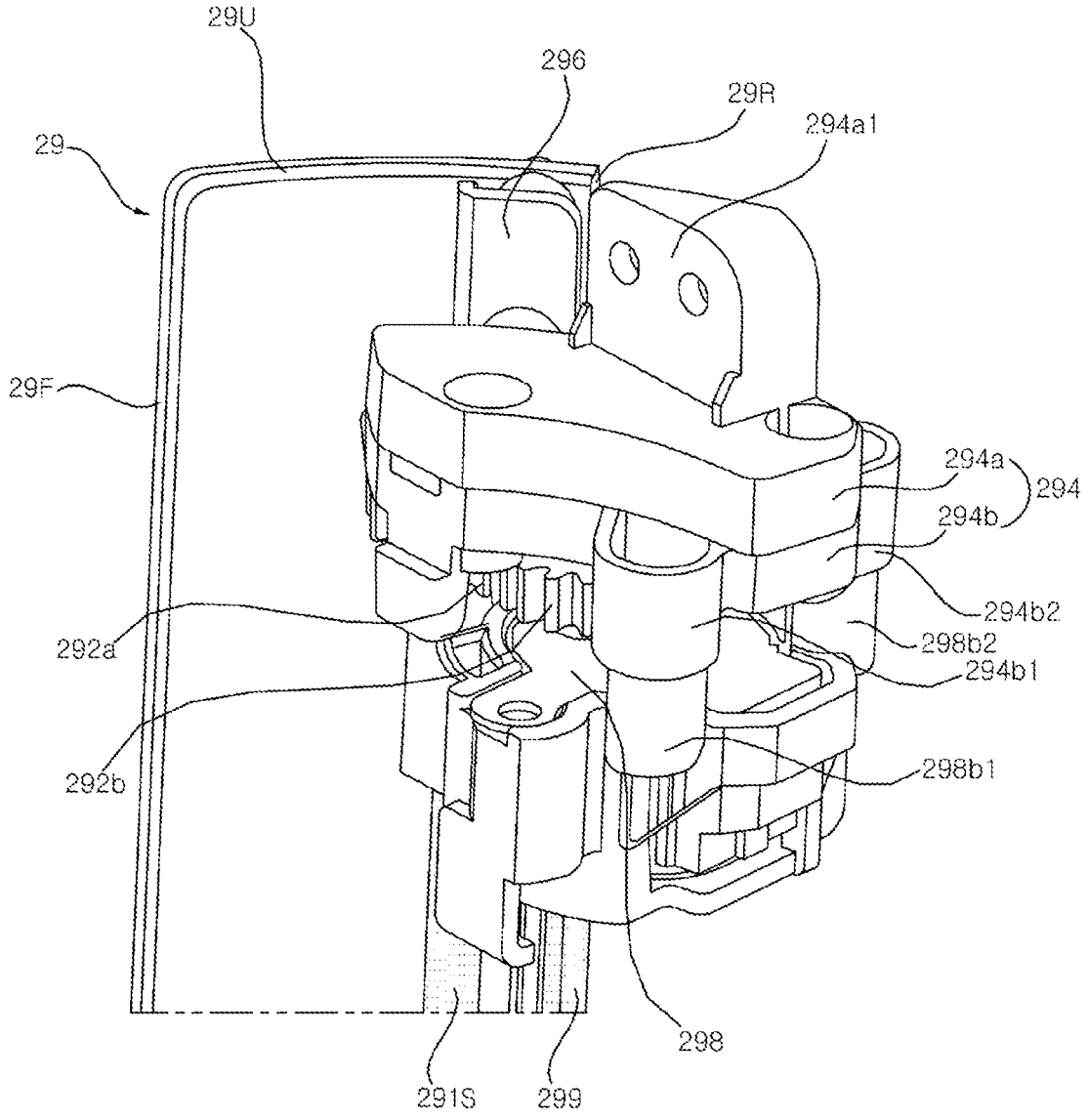
Figure 17:
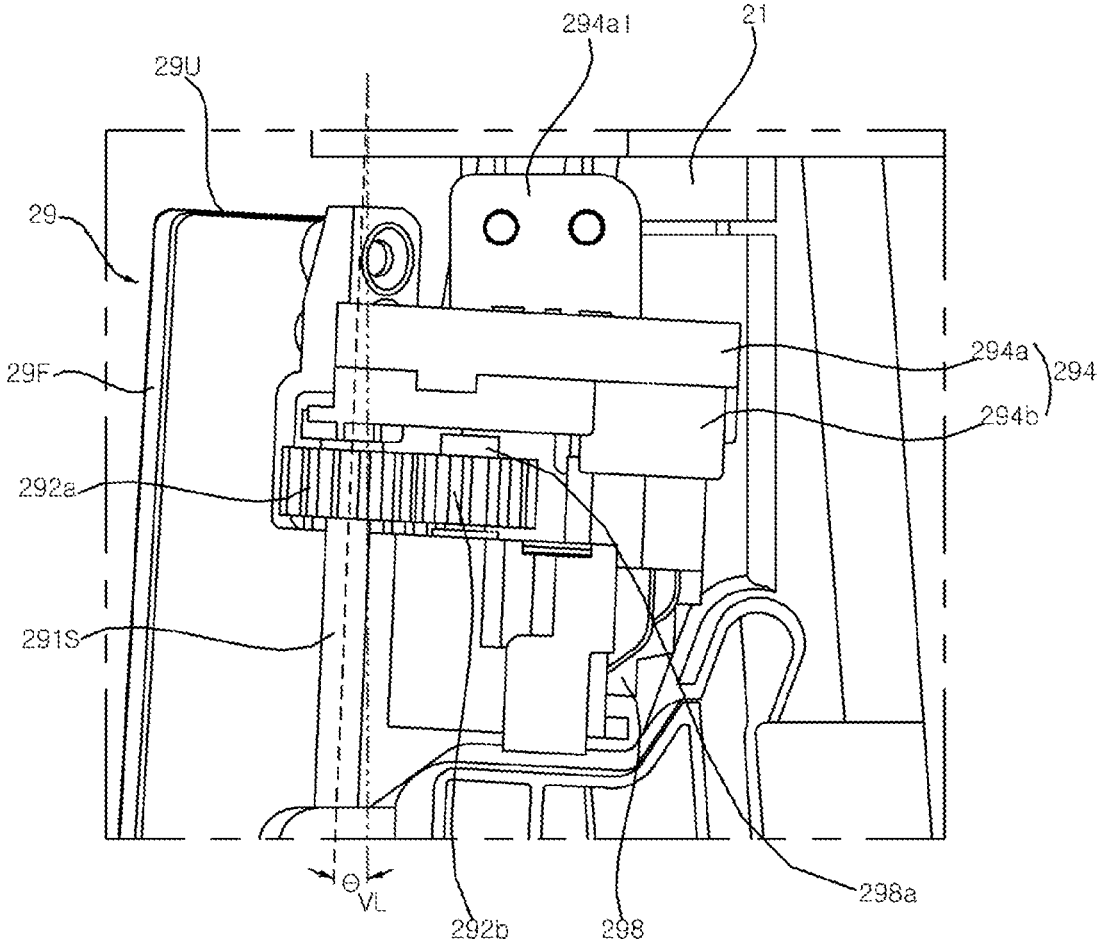

Referring to FIGS. 16 and 17, a motor 298 may be coupled to the second upper guide 294*b* from the lower side of the second upper guide 294*b*. For example, a first coupling portion 294*b*1, 249*b*2 may be formed in one side of the second upper guide 294*b*, and a second coupling portion 298*b*1, 283*b*2 may be formed in one side of the motor 298. In this case, the second coupling portion 298*b*1, 283*b*2 may be coupled to the first coupling portion 294*b*1, 249*b*2.

In addition, a rotation shaft 298*a* of the motor 298 may protrude toward the second upper guide 294*b* from the upper surface of the motor 298. A driving gear 292*b* may be fixed to the rotation shaft 298*a*. A first pinion 292*a* may be engaged with the driving gear 292*b* and may be fixed to the outer circumferential surface of a shaft 291S adjacent to the upper end of the shaft 291S. In addition, the first pinion 292*a* may be engaged with the upper rack 2961 (refer to FIG. 14). Here, the shaft 291S may extend long along the second damper 29. The upper end of the shaft 291S may be inserted into the first hole 294*ea* (refer to FIG. 15), and may be rotatably coupled to the first shaft holder 294*e* (refer to FIG. 15).

In this case, one or more of the longitudinal axis of the second damper 29, the longitudinal axis of the shaft 291S, the rotation center axis of the first pinion 292*a*, the rotation center axis of the driving gear 292*b*, and the rotation shaft 298*a* may be parallel to each other. For example, the longitudinal axis of the shaft 291S may be inclined by a certain angle (Θ) (e.g., an acute angle) with respect to the vertical line VL. The angle (Θ) may be substantially equal to the angle between the vertical line VL and the second slot 20H (refer to FIG. 1).

Figure 18:
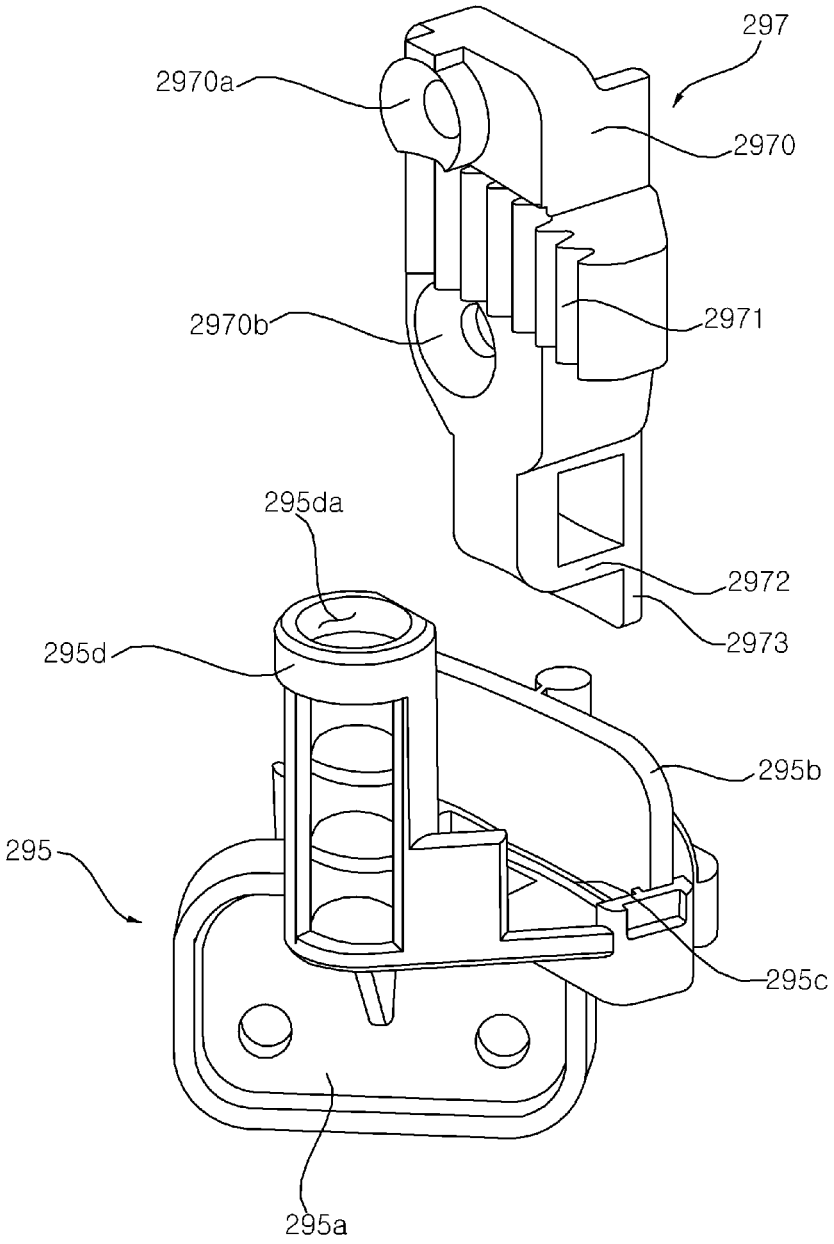
FIGS. 18 to 20 are views for explaining a lower configuration of the second moving assembly according to an embodiment of the present disclosure.

Referring to FIG. 18, the lower holder 297 may include one or more of a lower fixing portion 2970, a lower rack 2971, a lower horizontal rib 2972, and a lower vertical rib 2973. A lower fixing hole 2970*a*, 2970*b* may be formed to penetrate the lower fixing portion 2970. A fastening member such as a screw may penetrate the lower fixing hole 2970*a*, 2970*b* to be fastened to the inner surface of the second damper 29 (refer to FIG. 13).

The lower rack 2971 may be formed on the inner surface of the lower fixing portion 2970. The lower rack 2971 may be located between a first lower fixing hole 2970*a* and a second lower fixing hole 2970*b*. The lower rack 2971 may be bent along the curvature of the second damper 29 (refer to FIG. 5).

The lower horizontal rib 2972 may protrude from the inner surface of the lower fixing portion 2970 in the horizontal direction. The lower horizontal rib 2972 may be located in the lower side of the lower rack 2971.

The lower vertical rib 2973 may extend downward from the lower end of the lower fixing portion 2970 and may intersect the lower horizontal rib 2972. The lower vertical rib 2973 may be bent along the curvature of the lower rack 2971.

Figure 19:
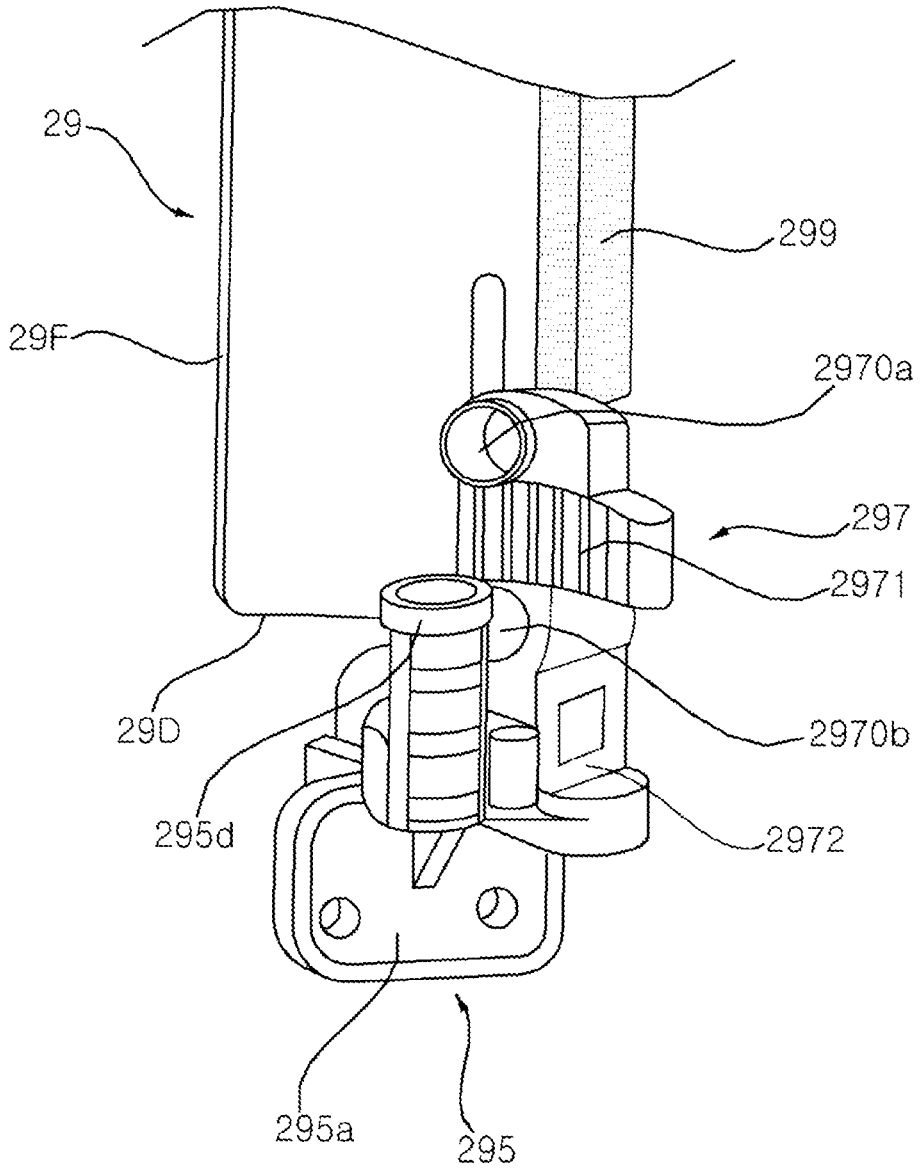

Referring to FIGS. 18 and 19, the lower guide 295 may be coupled to the lower holder 297 from the lower side of the lower holder 297. The mount 295*a* of the lower guide 295 may be fixed to the outer surface of the second wall 21 (refer to FIG. 20) in the second space 29S (refer to FIG. 5). For example, a lower guide groove 295*c* may be formed on the upper surface of the lower guide 295, and may guide the movement of the lower vertical rib 2973. In this case, the lower guide groove 295*c* may be bent along the curvature of the lower vertical rib 2973. In addition, a portion of the lower guide 295 may support the lower surface of the lower horizontal rib 2972.

Meanwhile, a second shaft holder 295*d* may protrude upward from the upper surface of the lower guide 295. A second hole 295*da* may be formed inside the second shaft holder 295*d*.

Figure 20:
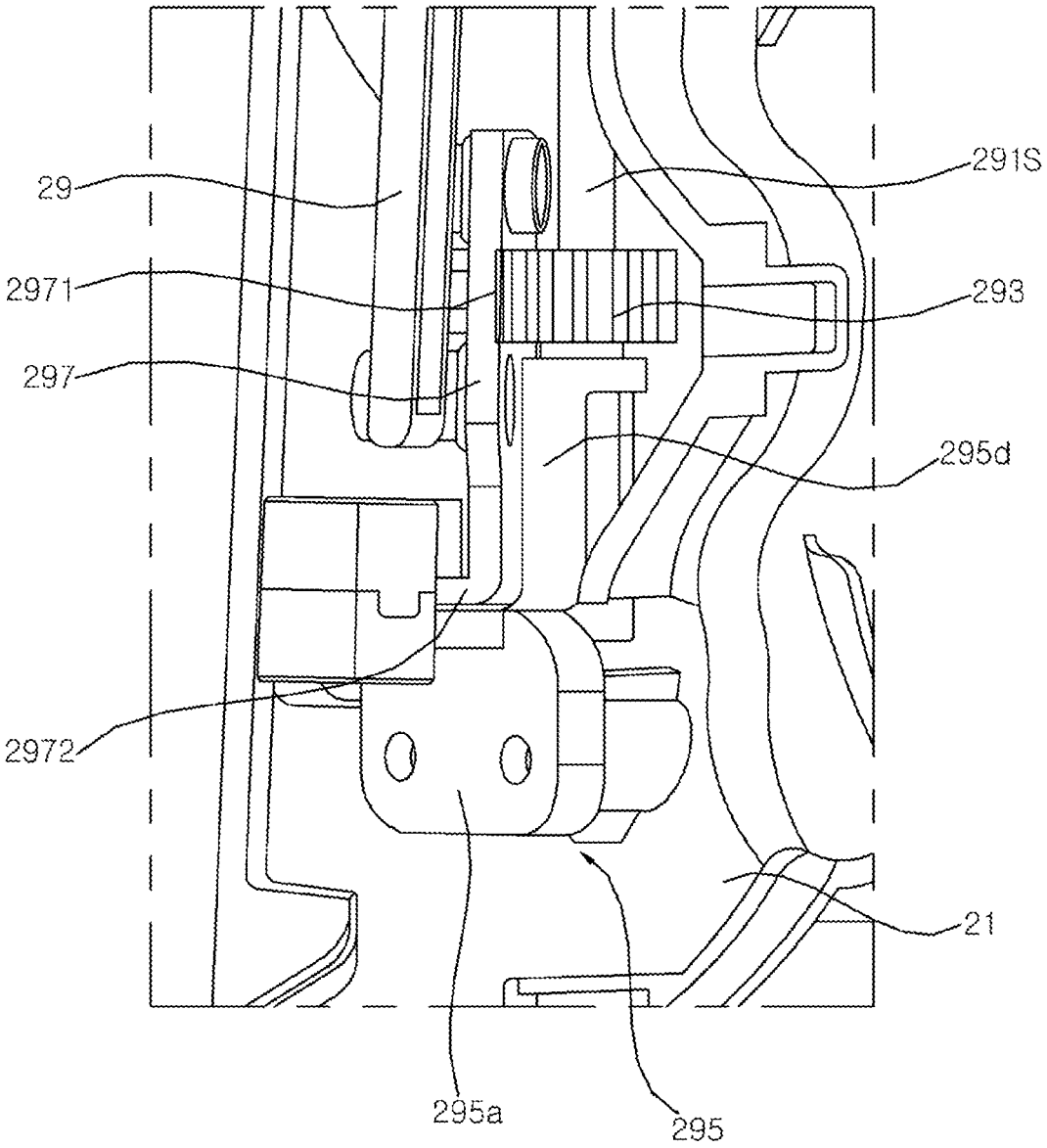

Referring to FIGS. 19 and 20, the lower end of the shaft 291S may be inserted into the second hole 295*da*, and may be rotatably coupled to the second shaft holder 295*d*. A second pinion 293 may be fixed to the outer circumferential surface of the shaft 291S adjacent to the lower end of the shaft 291S. In addition, the second pinion 293 may be engaged with the lower rack 2971. In this case, the rotation center axis of the second pinion 293 may be coaxial with the longitudinal axis of the shaft 291S.

Accordingly, when the motor 298 (refer to FIG. 17) is driven, the second damper 29 can move between a first state (refer to FIGS. 7 and 8) and a second state (refer to FIGS. 9 and 10) of the blower. Likewise, the first damper 19 may also be movable between the first state (refer to FIGS. 7 and 8) and the second state (refer to FIGS. 9 and 10) of the blower.

Figure 21:
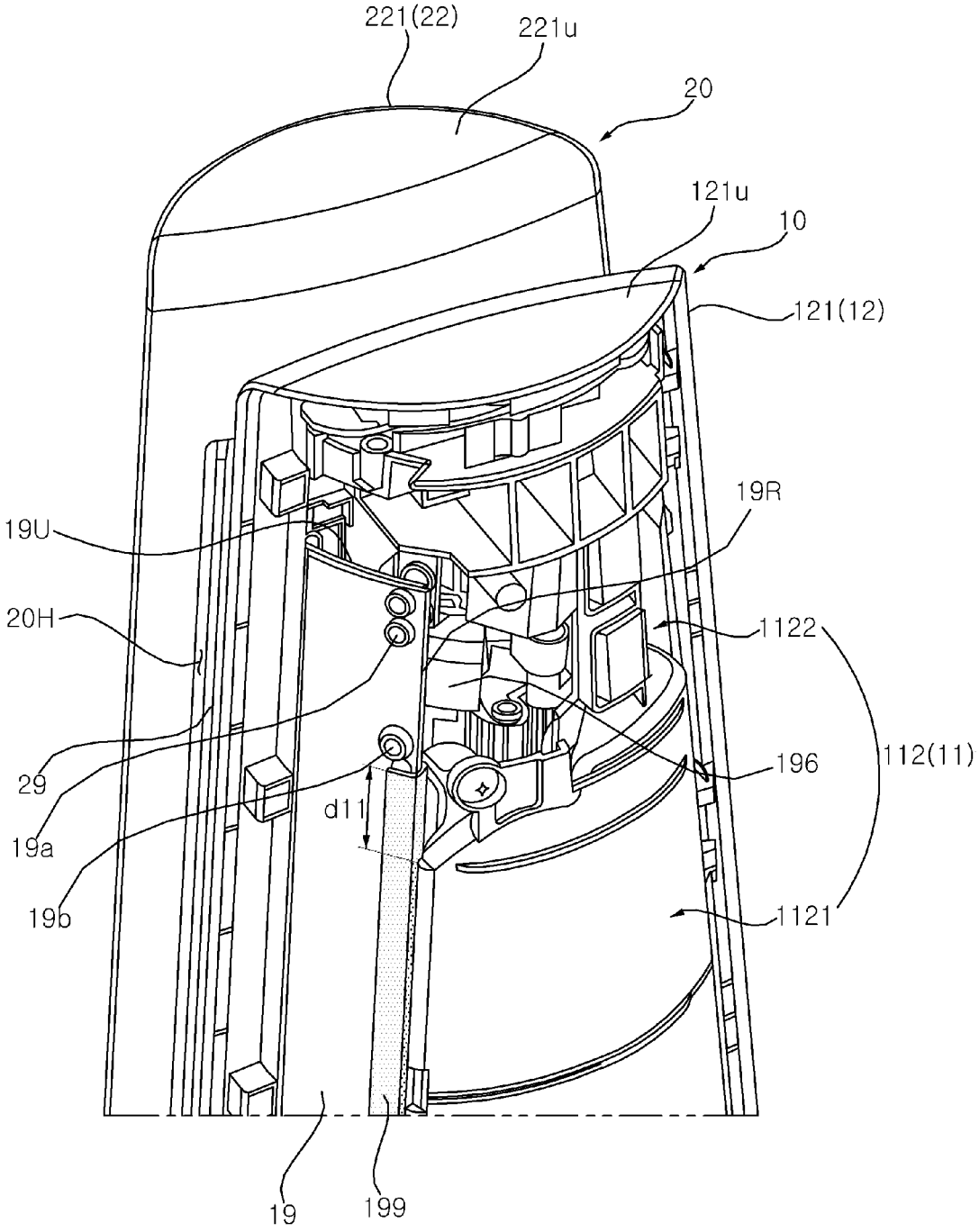
FIG. 21 is a view illustrating a state in which a first outer panel of a first upper body is removed according to an embodiment of the present disclosure.
Figure 22:
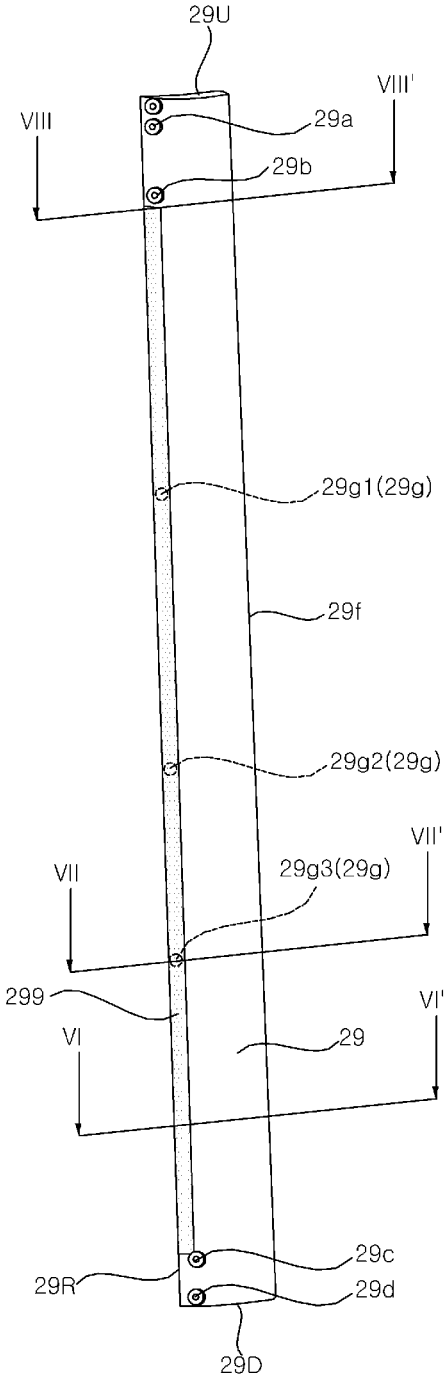
FIG. 22 is a perspective view of a second damper and a second bar coupled thereto as viewed from the outside of the second damper according to an embodiment of the present disclosure.

Referring to FIGS. 21 and 22, the second damper 29 may include an upper boss 29*a*, 29*b* and a lower boss 29*c*, 29*d*. The upper boss 29*a*, 29*b* may be adjacent to the upper end 29U and the rear end 29R of the second damper 29, and the upper boss 29*a*, 29*b* may be formed on the inner surface and/or outer surface of the second damper 29. A first upper boss 29*a* may be aligned with the first upper fixing hole 2960*a* (refer to FIG. 14) of the upper fixing portion 2960. A second upper boss 29*b* may be aligned with the second upper fixing hole 2960*b* (refer to FIG. 14) of the upper fixing portion 2960. In one example, the fastening member such as a screw may be fastened to the upper boss 29*a*, 29*b* by penetrating the upper fixing hole 2960*a*, 2960*b* (refer to FIG. 14).

The lower boss 29*c*, 29*d* may be adjacent to the lower end 29D and the rear end 29R of the second damper 29, and may be formed on the inner surface and/or outer surface of the second damper 29. The first lower boss 29*c* may be aligned with the first lower fixing hole 2970*a* (refer to FIG. 18) of the lower fixing portion 2970. The second lower boss 29*d* may be aligned with the second lower fixing hole 2970*b* (refer to FIG. 18) of the lower fixing portion 2970. In one example, the fastening member such as a screw may be fastened to the lower boss 29*c*, 29*d* by penetrating the lower fixing hole 2970*a*, 2970*b* (refer to FIG. 18).

The bar 299 may extend long along the rear end 29R of the second damper 29. The bar 299 may be coupled to the rear end 29R of the second damper 29. For example, the second damper 29 may include a resin material. For example, the bar 299 may include a metal material such as iron Fe or aluminum Al. Accordingly, the bar 299 may improve the rigidity of the second damper 29.

A portion corresponding to the upper boss 29*a*, 29*b* of the second damper 29 may have improved rigidity by the upper holder 296 (refer to FIG. 13). A portion of the second damper 29 corresponding to the lower boss 29*c*, 29*d* may have improved rigidity by the lower holder 297 (refer to FIG. 13). In this case, the upper end of the bar 299 may be adjacent to the upper boss 29*a*, 29*b*, and the lower end of the bar 299 may be adjacent to the lower boss 29*c*, 29*d*. For example, a portion located between the upper boss 29*a*, 29*b* and the lower boss 29*c*, 29*d* of the second damper 29 may have improved rigidity by the bar 299.

Accordingly, the rigidity of the second damper 29 may be improved as a whole. Meanwhile, the bar 299 may be referred to as an edge cover, a strip, or a reinforcement part.

Referring back to FIGS. 3 and 21, the first outer wall 112 may include a first base wall 1121 and a first mount wall 1122. The first base wall 1121 may face the first inner wall 111 and form a boundary of the first flow path 10P. The first mount wall 1122 may extend upwardly from the first base wall 1121, and may be adjacent to the upper holder 196.

In one example, the upper end of the bar 199 fixed to the rear end 19R of the first damper 19 may be located in the upper side of the first base wall 1121 (refer to d11 of FIG. 21). Accordingly, the bar 199 may improve the rigidity of other portion of the first damper 19 as well as a portion corresponding to the first flow path 10P of the first damper 19 (i.e., a portion located in the flow path of the air that is discharged from the first slit 10SL (refer to FIG. 4) and passes through the space S).

Meanwhile, the above description may be identically applied to the second damper 29 and the bar 299 coupled thereto. Alternatively, any one of a first damper assembly including the first damper 19 and the bar 199 and a second damper assembly including the second damper 29 and the bar 299 may be omitted.

Figure 23:
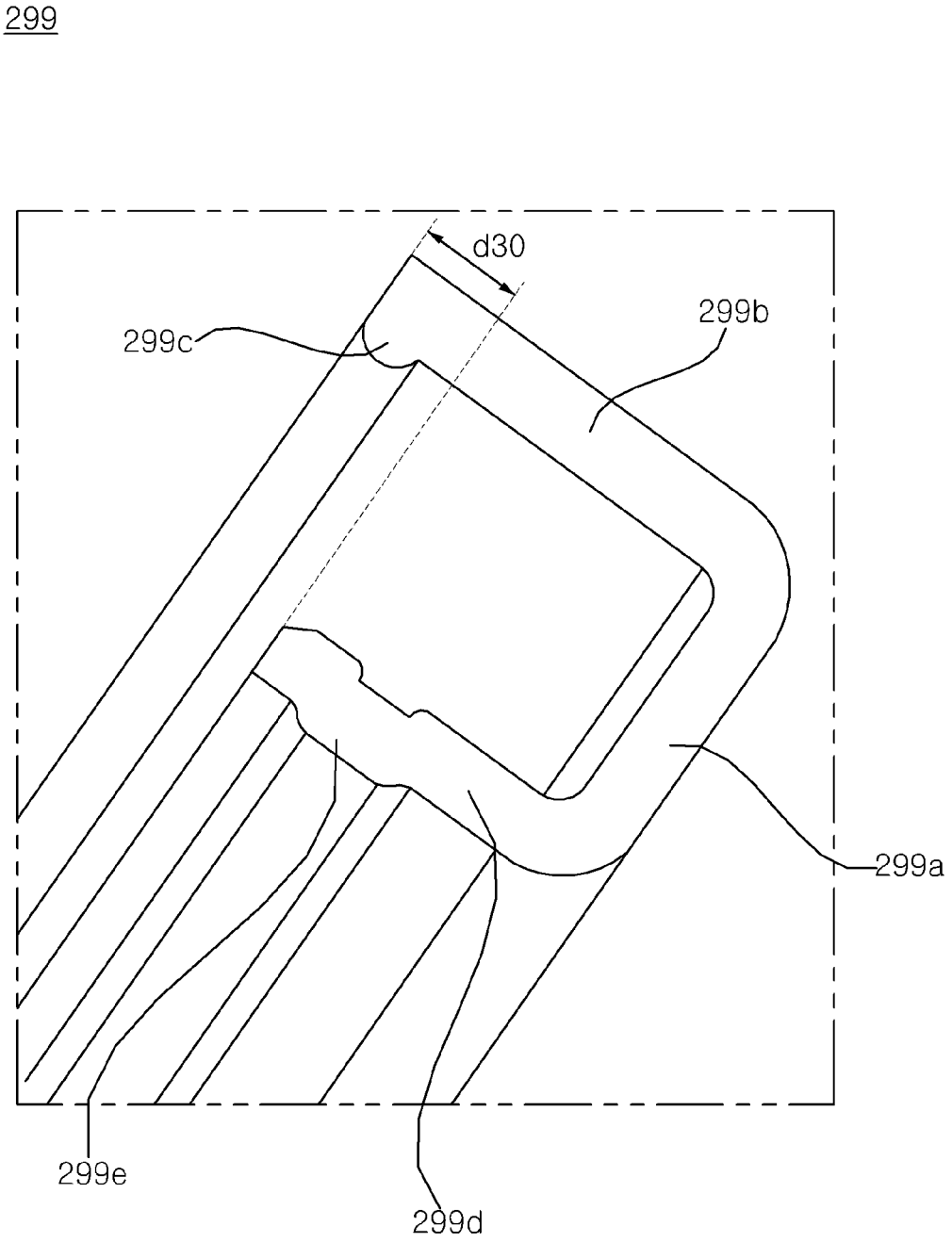
FIG. 23 is a perspective view of a bar according to an embodiment of the present disclosure.
Figure 24:
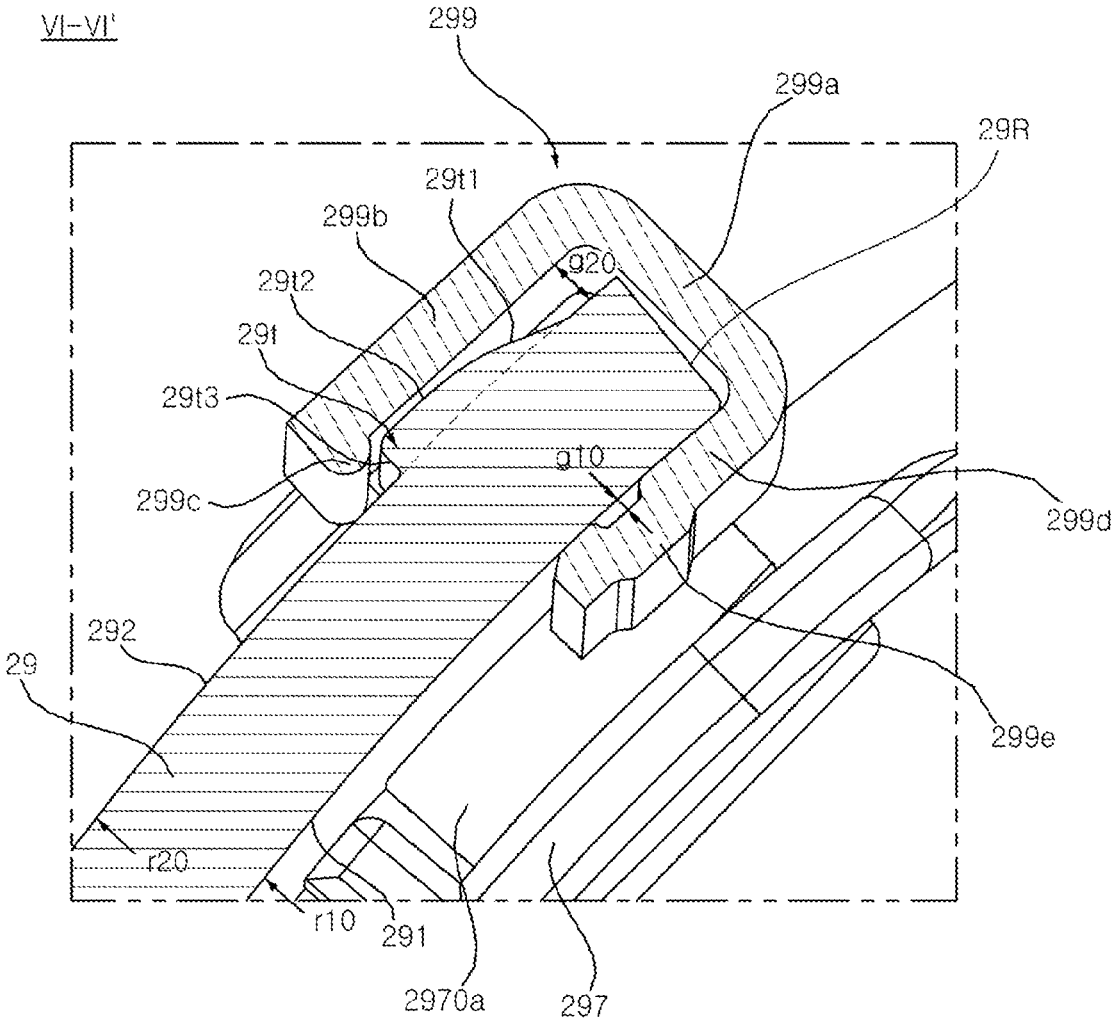
FIGS. 24 and 25 are cross-sectional views taken along line VI-VI' of FIG. 22.

Referring to FIGS. 23 and 24, the second damper 29 may be curved. The radius of curvature r20 of the outer surface 292 of the second damper 29 may be greater than the radius of curvature r10 of the inner surface 291 of the second damper 29. For example, the curvature of the outer surface 292 of the second damper 29 may be smaller than the curvature of the inner surface 291 of the second damper 29.

The bar 299 may be elastically coupled to the second damper 29. For example, the bar 299 may include a first part (or first bar wall) 299*a*, a second part (or second bar wall) 299*b*, and a third part (or third bar wall) 299*d*. The first part 299*a* may face the rear end 29R of the second damper 29. The second part 299*b* may be bent from the first part 299*a* and may face the outer surface 292 of the second damper 29. The third part 299*d* may be bent from the first part 299*a* and may face the inner surface 291 of the second damper 29. In one example, a portion of the second damper 29 may be inserted between the second part 299*b* and the third part 299*d*.

In addition, the length of the second part 299*b* with respect to the first part 299*a* may be greater than the length of the third part 299*d* with respect to the first part 299*a* by a certain length d30. In this example, in the thickness direction of the second damper 29, a portion of the second part 299*b* may overlap the third part 299*d*.

A protrusion 29*t* may protrude from the outer surface 292 of the second damper 29 toward the second part 299*b*, and may be adjacent to the rear end 29R of the second damper 29. The protrusion 29*t* may extend long in the length direction of the second damper 29. The protrusion 29*t* may be formed as one body with the second damper 29. The protrusion 29*t* may include an inclined portion (or inclined surface) 29*t*1, a horizontal portion (or horizontal surface) 29*t*2, and a vertical portion (or vertical surface) 29*t*3. The inclined portion 29*t*1 may be formed to be inclined with respect to a boundary (refer to the dotted line in FIG. 24) between the protrusion 29*t* and the second damper 29. The horizontal portion 29*t*2 may be connected to the inclined portion 29*t*1 and may be formed parallel to the boundary. The vertical portion 29*t*3 may be connected to the horizontal portion 29*t*2 and may be formed perpendicular to the boundary.

A locking portion (or locking extension) 299*c* may protrude toward the second damper 29 from the distal end of the second part 299*b*. In the process of coupling the bar 299 to the second damper 29, the locking portion 299*c* may be caught by the vertical portion 29*t*3 after sliding on the inclined portion 29*t*1 and the horizontal portion 29*t*2, and the third part 299*d* may contact the inner surface 291 of the second damper 29. In the process of separating the second damper 29 and the bar 299, the bar 299 may be opened, and the locking portion 299*c* may be released from the vertical portion 29*t*3.

Accordingly, the bar 299 may be detachably coupled to the second damper 29. For example, the distal end of the locking portion 299*c* may be formed to be rounded. In this case, the coupling and separation of the locking portion 299*c* with respect to the protruding portion 29*t* may be performed smoothly.

A rigid portion (or arch) 299*e* may be formed while being pressed outwardly from the inner surface of the third part 299*d*. A first gap g10 may be formed between the inner surface 291 of the second damper 29 and the rigid portion 299*e*. The rigid portion 299*e* may improve the rigidity of the bar 299, and as a result, the rigidity of the second damper 29 may be improved. Meanwhile, in some embodiment, the bar 299 may further include at least one other rigid portion (or brace) formed in the first part 299*a*, the second part 299*b*, and/or the third part 299*d* in addition to the rigid portion 299*e* described above.

Figure 25:
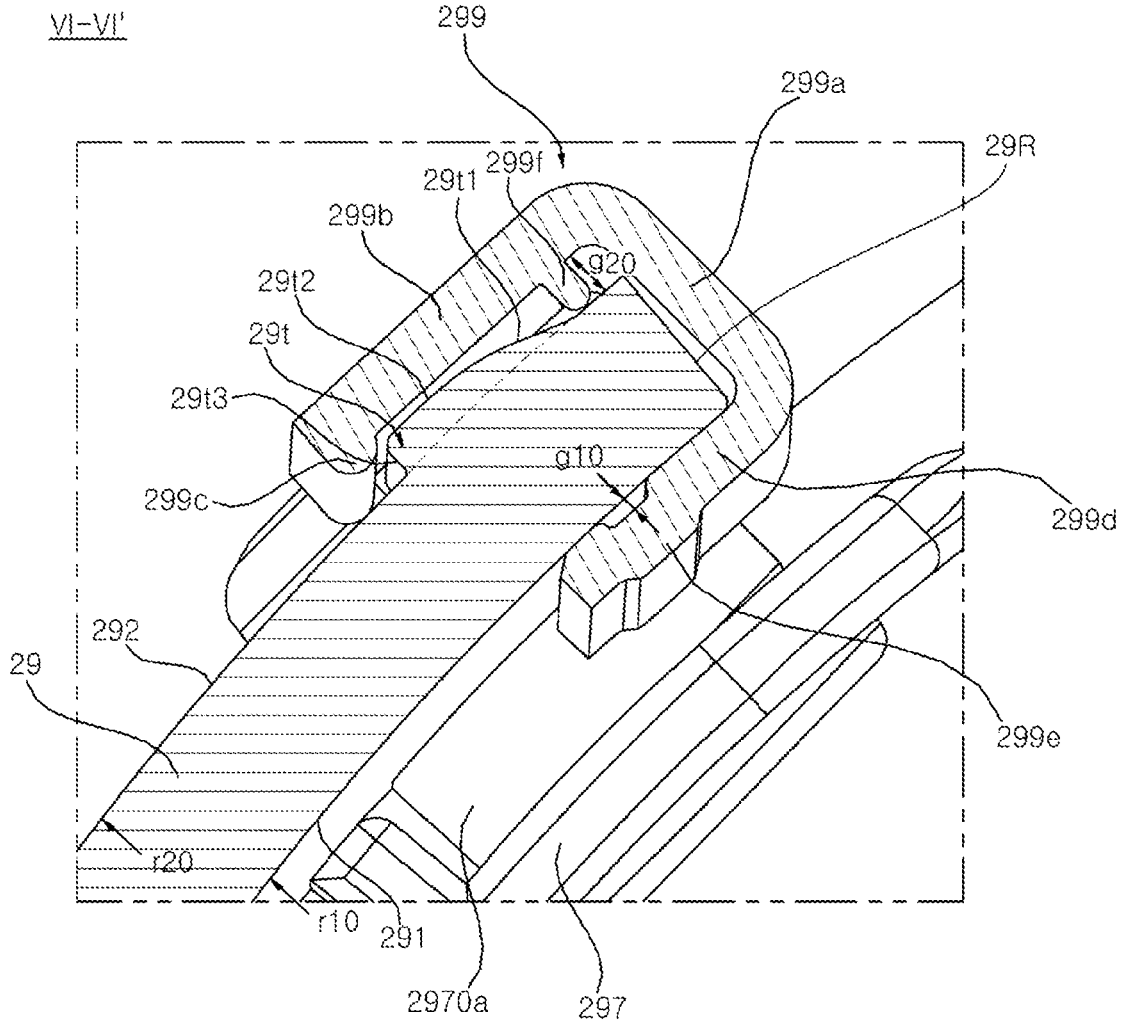

Referring to FIG. 25, a second gap g20 may be formed between the outer surface 292 of the second damper 29 and the second part 299*b*. An inner protrusion 299*f* may protrude from the inner surface of the second part 299*b* toward the outer surface 292 of the second damper 29, and may be located in the second gap g20. The distal end of the inner protrusion 299*f* may contact the outer surface 292 of the second damper 29, and may improve the rigidity of the second damper 29.

For example, the inner protrusion 299*f* may extend along the protrusion 29*t*. As another example, the inner protrusion 299*f* may include a plurality of inner protrusions spaced apart from each other in the length direction of the protrusion 29*t*.

Figure 26:
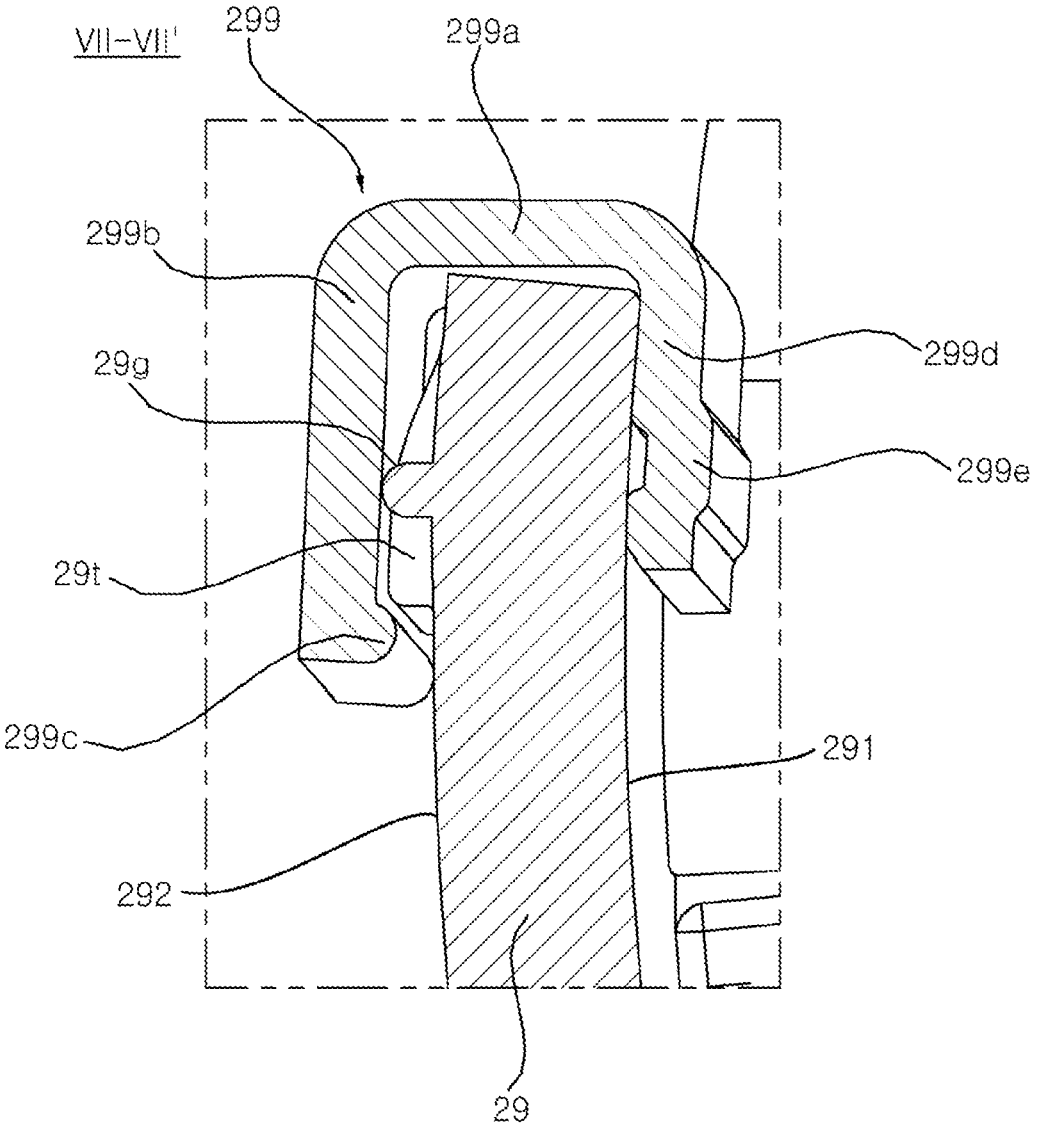
FIG. 26 is a cross-sectional view taken along line VII-VII' of FIG. 22.

Referring to FIGS. 22 and 26, a pin 29*g* may be formed on the outer surface 292 of the second damper 29. For example, the pin 29*g* may include a plurality of pins 29*g*1, 29*g*2, and 29*g*3 spaced apart from each other in the length direction of the second damper 29. In this case, the protrusion 29*t* may include a plurality of protrusions spaced apart from each other with the pin 29*g* interposed therebetween. The second part 299*b* may cover the pin 29*g*. The pin 29*g* may be referred to as a gate.

Figure 27:
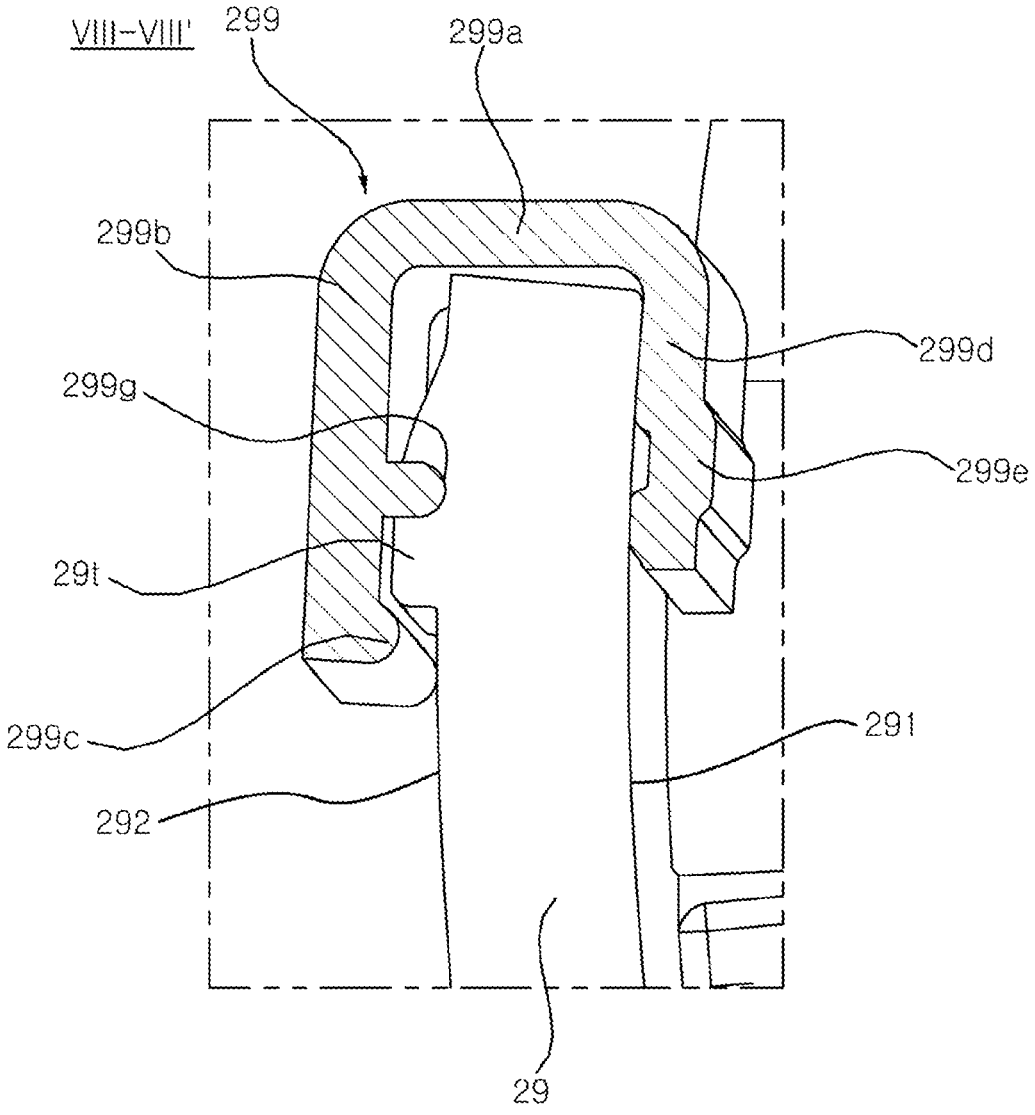
FIG. 27 is a cross-sectional view taken along line VIII-VIII' of FIG. 22.

Referring to FIG. 27, the guide protrusion 299*g* may protrude from the inner surface of the second part 299*b* toward the third part 299*d*, and the guide protrusion 299*g* may be located in the upper end of the protrusion 29*t*. Accordingly, the guide protrusion 299*g* may guide the coupling of the bar 299 to the second damper 29. In this example, a user may couple the bar 299 to the second damper 29 while the guide protrusion 299*t* is in contact with the upper end of the protrusion 29*t*.

In the above discussion of FIGS. 22-29, certain attributes of second bar 299 are discussed with respect to second damper 29. It should be appreciated that the above description of second bar 299 with respect to second damper 29 may be identically applied to the first damper 19 and the first bar 199 coupled thereto.

Referring to FIGS. 1 to 27, the blower may include: a fan that generates a flow of air; a lower body that includes an internal space in which the fan is installed, and a suction hole providing air to the fan; a first upper body that is positioned above the lower body, communicates with the internal space of the lower body, and has a surface at which a first discharge hole is formed; a first damper that is movably coupled to the first upper body to selectively penetrate the surface of the first upper body, the first damper having a first end facing an outside of the first upper body, and a second end opposite to the first end; and a first bar extending along and coupled to the second end of the first damper.

The blower may further comprise a second upper body that is positioned above the lower body, is spaced apart from the first upper body, communicates with the internal space of the lower body, and has a surface at which a second discharge hole is formed, and the first damper may be movable in a direction close to or away from the surface of the second upper body.

The blower may further comprise a second damper that is movably coupled to the second upper body to selectively penetrate the surface of the second upper body, the second damper having a first end facing a space formed between the surfaces of the first upper body and the second upper body, and a second end opposite to the first end.

The blower may further comprise a second bar extending along and coupled to the second end of the second damper The first damper and the second damper may be symmetrical to each other with respect to the space. A moving direction of the first damper may be opposite to a moving direction of the second damper, and the one end of the first damper may face the one end of the second damper in the moving direction of the first damper.

The first bar may further include: a first part facing the other end of the first damper; a second part bent at one end of the first part, and facing an outer surface of the first damper; and a third part bent at the other end of the first part, and facing an inner surface of the first damper, wherein a portion of the first damper may be positioned between the second part and the third part.

The first damper may have an arc-shaped cross-section and may be movable in a length direction of the arc, wherein the first bar may have elasticity and may be detachably coupled to the first damper.

A radius of curvature of the outer surface of the first damper may be greater than a radius of curvature of the inner surface of the first damper, wherein the first damper may include a protrusion protruding from the outer surface of the first damper toward the second part and adjacent to a rear end of the first damper, and wherein the first bar may further include a locking portion protruding toward the first damper from a distal end of the second part, and caught by the protrusion.

The protrusion may further include: an inclined portion inclined with respect to a boundary between the protrusion and the first damper; a horizontal portion connected to the inclined portion, and formed parallel to the boundary; and a vertical portion connected to the horizontal portion, formed perpendicular to the boundary, and by which the locking portion is caught. A distal end of the locking portion may be formed to be round.

The first bar may further include a guide protrusion protruding from an inner surface of the second part toward the third part, and positioned on the protrusion. The first damper may further include a plurality of pins formed at the outer surface of the first damper and spaced apart from each other in a length direction of the first damper, wherein the second part may cover the plurality of pins.

The first bar may further include a rigid portion which is formed while being pressed outward from an inner surface of the third part. The first bar may further include an inner protrusion protruding from an inner surface of the second part toward the first damper, and in contact with the outer surface of the first damper.

The first damper may further include: an upper boss formed at an inner surface of the first damper, and adjacent to an upper end and the other end of the first damper; and a lower boss formed at the inner surface of the first damper, and adjacent to a lower end and the other end of the first damper; wherein an upper end of the first bar may be adjacent to the upper boss, and a lower end of the first bar may be adjacent to the lower boss.

The blower may further include a first moving assembly including an upper holder fastened to the upper boss and a lower holder fastened to the lower boss, wherein the first moving assembly may include: a motor providing power; a driving gear fixed to a rotation shaft of the motor; a first pinion engaged with the driving gear; a shaft to which the first pinion is fixed; and a second pinion fixed to the shaft, and spaced apart from the first pinion, wherein the upper holder may include an upper rack formed at the upper holder and engaged with the first pinion, wherein the lower holder may include a lower rack formed at the lower holder and engaged with the second pinion. The first damper and the second damper may include a resin material, wherein the first bar and the second bar may include a metal material.

Aspects of the blower according to the present disclosure will be described as follows. According to at least one of the embodiments of the present disclosure, a blower capable of adjusting the blowing direction may be provided. According to at least one of the embodiments of the present disclosure, a driving mechanism of the damper for controlling the blowing direction of the blower may be provided. According to at least one of the embodiments of the present disclosure, a structure capable of improving the rigidity of the damper may be provided. According to at least one of the embodiments of the present disclosure, a bar that can be easily coupled to or detached from the damper may be provided.

Certain embodiments or other embodiments of the invention described above are not mutually exclusive or distinct from each other. Any or all elements of the embodiments of the invention described above may be combined or combined with each other in configuration or function. For example, a configuration "A" described in one embodiment of the invention and the drawings and a configuration "B" described in another embodiment of the invention and the drawings may be combined with each other. Namely, although the combination between the configurations is not directly described, the combination is possible except in the case where it is described that the combination is impossible.

An aspect of the present disclosure is to provide a blower capable of controlling the blowing direction. Another aspect may be to provide a driving mechanism of the damper for controlling the blowing direction of the blower. Another aspect may be to a structure capable of improving the rigidity of a damper. Another aspect may be to provide a bar that can be easily coupled to or detached from the damper.

According to an aspect of the present disclosure for achieving the above and other objects, a blower includes: a fan that generates a flow of air; a lower body that includes an internal space in which the fan is installed, and a suction hole providing air to the fan; a first upper body that is positioned above the lower body, communicates with the internal space of the lower body, and has a surface at which a first discharge hole is formed; a first damper that is movably coupled to the first upper body to selectively penetrate the surface of the first upper body, the first damper having a first end facing an outside of the first upper body, and a second end opposite to the first end; and a first bar extending along and coupled to the second end of the first damper.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A blower, comprising:

a fan that generates a flow of air;

a lower body that includes an internal space in which the fan is installed, and a suction hole providing air to the fan;

a first upper body that is positioned above the lower body, communicates with the internal space of the lower body, and has a surface at which a first discharge hole is formed;

a second upper body that is positioned above the lower body, is spaced apart from the first upper body, communicates with the internal space of the lower body, and has a surface at which a second discharge hole is formed;

a first damper that is movably coupled to the first upper body to selectively penetrate the surface of the first upper body, the first damper having a first end facing an outside of the first upper body, and a second end opposite to the first end, the first damper being movable in a direction close to or away from the surface of the second upper body; and a first bar extending along and coupled to the second end of the first damper.

2. The blower of claim 1, further comprising:

a second damper that is movably coupled to the second upper body to selectively penetrate the surface of the second upper body, the second damper having a first end facing a space formed between the surfaces of the first upper body and the second upper body, and a second end opposite to the first end; and a second bar extending along and coupled to the second end of the second damper, wherein the first damper and the second damper are symmetrical to each other with respect to the space, wherein a moving direction of the first damper is opposite to a moving direction of the second damper, and the first end of the first damper faces the first end of the second damper in the moving direction of the first damper.

3. The blower of claim 1, wherein the first bar includes:

a first wall facing the second end of the first damper;

a second wall extending from a first end of the first wall and facing an outer surface of the first damper; and a third wall extending from a second end of the first wall and facing an inner surface of the first damper, wherein a portion of the first damper is positioned between the second wall and the third wall.

4. The blower of claim 3, wherein the first damper has an arc-shaped cross-section and is movable in a length direction of the first damper, and wherein the first bar is detachably coupled to the first damper due to an elastic force applied by the second wall and the third wall to the first damper.

5. The blower of claim 4, wherein a radius of curvature of the outer surface of the first damper is greater than a radius of curvature of the inner surface of the first damper, wherein the first damper includes a protrusion that protrudes from the outer surface of the first damper toward the second wall and is adjacent to the second end of the first damper, and wherein the first bar includes a locking extension that protrudes toward the first damper from a distal end of the second wall, and is caught by the protrusion.

6. The blower of claim 5, wherein the protrusion includes:

an inclined surface inclined with respect to a boundary between the protrusion and the first damper;

a horizontal surface connected to the inclined surface, and formed parallel to the boundary; and a vertical surface connected to the horizontal surface, formed perpendicular to the boundary, and by which the locking extension is caught.

7. The blower of claim 6, wherein a distal end of the locking extension has a round cross-section shape.

8. The blower of claim 5, wherein the first bar includes a guide protrusion protruding from an inner surface of the second wall toward the third wall, and positioned on the protrusion.

9. The blower of claim 5, wherein the first damper includes a plurality of pins formed at the outer surface of the first damper and spaced apart from each other in a length direction of the first damper, and wherein the second wall covers the plurality of pins.

10. The blower of claim 3, wherein the first bar further comprises an arch which extends outward from the third wall.

11. The blower of claim 3, wherein the first bar further includes an inner protrusion that protrudes from an inner surface of the second wall toward the first damper, and is in contact with the outer surface of the first damper.

12. The blower of claim 1, wherein the first damper further includes:

an upper boss that is formed at an inner surface of the first damper, and is adjacent to an intersection of an upper end and the second end of the first damper; and a lower boss that is formed at the inner surface of the first damper, and is adjacent to an intersection of a lower end and the second end of the first damper, and wherein an upper end of the first bar is adjacent to the upper boss, and a lower end of the first bar is adjacent to the lower boss.

13. The blower of claim 12, further comprising:

an upper holder fastened to the upper boss;

a lower holder fastened to the lower boss;

a motor;

a driving gear fixed to a rotation shaft of the motor;

a first pinion engaged with the driving gear;

a shaft to which the first pinion is fixed; and a second pinion fixed to the shaft, and spaced apart from the first pinion, wherein the upper holder includes an upper rack that is engaged with the first pinion, and wherein the lower holder includes a lower rack that is engaged with the second pinion.

14. A blower, comprising:

a fan that generates a flow of air;

a lower body that includes an internal space in which the fan is installed, and a suction hole providing air to the fan;

a first upper body that is positioned above the lower body, communicates with the internal space of the lower body, and has a surface at which a first discharge hole is formed;

a second upper body that is positioned above the lower body, communicates with the internal space of the lower body, and having one surface at which a second discharge hole is formed;

a first damper that is movably coupled to the first upper body to selectively penetrate the surface of the first upper body, the first damper having a first end facing a space formed between the surfaces of the first upper body and the second upper body, and a second end opposite to the first end;

a second damper that is movably coupled to the second upper body to selectively penetrate the surface of the second upper body, the second damper having a first end facing the space and a second end opposite to the first end; and a first bar extending along and coupled to the second end of the first damper, the first bar including, a first wall facing the second end of the first damper;

a second wall extending from a first end of the first wall and facing an outer surface of the first damper; and a third wall extending from a second end of the first wall and facing an inner surface of the first damper.

15. The blower of claim 14, wherein the first damper has an arc-shaped cross-section and is movable in a length direction of the first damper, and wherein the first bar is detachably coupled to the first damper due to an elastic force applied by the second wall and the third wall to the first damper.

16. The blower of claim 4, wherein a radius of curvature of the outer surface of the first damper is greater than a radius of curvature of the inner surface of the first damper, wherein the first damper includes a protrusion that protrudes from the outer surface of the first damper toward the second wall and is adjacent to the second end of the first damper, and wherein the first bar includes a locking extension that protrudes toward the first damper from a distal end of the second wall and is caught by the protrusion.

17. The blower of claim 16, wherein the protrusion includes:

an inclined surface inclined with respect to a boundary between the protrusion and the first damper;

a horizontal surface connected to the inclined surface, and formed parallel to the boundary; and a vertical surface connected to the horizontal surface, formed perpendicular to the boundary, and by which the locking extension is caught.

18. The blower of claim 16, wherein the first bar includes a guide protrusion protruding from an inner surface of the second wall toward the third wall, and received on the protrusion of the first damper.

19. A blower, comprising:

a fan that generates a flow of air;

a lower body that includes an internal space in which the fan is installed, and a suction hole providing air to the fan;

a first upper body that is positioned above the lower body, communicates with the internal space of the lower body, and has a surface at which a first discharge hole is formed;

a first damper that is movably coupled to the first upper body to selectively penetrate the surface of the first upper body, the first damper having a first end facing an outside of the first upper body, and a second end opposite to the first end; and a first bar extending along and coupled to the second end of the first damper, wherein the first bar includes:

a first wall facing the second end of the first damper;

a second wall extending from a first end of the first wall and facing an outer surface of the first damper; and a third wall extending from a second end of the first wall and facing an inner surface of the first damper, and wherein a portion of the first damper is positioned between the second wall and the third wall.

* * * * *